US011281135B2

(12) United States Patent
Sato et al.

(10) Patent No.: US 11,281,135 B2
(45) Date of Patent: Mar. 22, 2022

(54) FIXING APPARATUS SWITCHING HEAT GENERATION MEMBERS AND IMAGE FORMING APPARATUS

(71) Applicant: CANON KABUSHIKI KAISHA, Tokyo (JP)

(72) Inventors: Yutaka Sato, Komae (JP); Kazuhiro Doda, Yokohama (JP); Kohei Wakatsu, Kawasaki (JP); Tsuguhiro Yoshida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/150,059

(22) Filed: Jan. 15, 2021

(65) Prior Publication Data

US 2021/0132528 A1 May 6, 2021

Related U.S. Application Data

(63) Continuation of application No. 16/746,063, filed on Jan. 17, 2020, now Pat. No. 10,921,737.

(30) Foreign Application Priority Data

Jan. 18, 2019 (JP) ..... JP2019-006466

(51) Int. Cl.
*G03G 15/20* (2006.01)

(52) U.S. Cl.
CPC ..... *G03G 15/2039* (2013.01)

(58) Field of Classification Search
None
See application file for complete search history.

(56) References Cited

U.S. PATENT DOCUMENTS

| | | | | |
|---|---|---|---|---|
| 5,640,231 | A * | 6/1997 | Mitsui | G03G 15/2003 219/216 |
| 6,397,021 | B2 * | 5/2002 | Hayashi | G03G 15/205 219/216 |
| 6,580,883 | B2 | 6/2003 | Suzumi | |
| 2010/0080590 | A1 | 4/2010 | Takahashi | |

FOREIGN PATENT DOCUMENTS

| | | | |
|---|---|---|---|
| JP | 10-301443 | A | 11/1998 |
| JP | 2001-100558 | A | 4/2001 |
| JP | 2013-235181 | A | 11/2013 |

* cited by examiner

*Primary Examiner* — Victor Verbitsky
(74) *Attorney, Agent, or Firm* — Venable LLP

(57) ABSTRACT

In a case where fixing processing is performed continuously on sheets having a width that is shorter than a length of a heat generation member in a longitudinal direction and longer than a length of another heat generation member in the longitudinal directions, the CPU determines a timing to switch between the heat generation member and the another heat generation member by a heat generation member switching device based on information relating to a size of the sheet.

23 Claims, 20 Drawing Sheets

CROSS SECTION p-p'

FIXING APPARATUS SWITCHING HEAT GENERATION MEMBERS AND IMAGE FORMING APPARATUS

CROSS-REFERENCE TO RELATED APPLICATIONS

The present application is a Continuation of U.S. patent application Ser. No. 16/746,063, filed Jan. 17, 2020, which claims the benefit of Japanese Patent Application No. 2019-006466, filed Jan. 18, 2019, the entire contents of which are both hereby incorporated by reference herein.

BACKGROUND OF THE INVENTION

Field of the Invention

The present invention relates to a fixing apparatus and an image forming apparatus including the fixing apparatus.

Description of the Related Art

An electrophotographic copying machine and an electrophotographic printer is equipped with a fixing apparatus that heats and fixes a toner image formed on a recording material. In such a fixing apparatus, when print is performed continuously on recording materials with a width narrower than that of a recording material having a maximum size for print in the image forming apparatus (hereinafter, referred to as small size sheet), the following phenomenon occurs. That is, in regions of the fixing nip portion in the longitudinal direction where a small size sheet does not pass (hereinafter, referred to as non-sheet-feeding portions), a phenomenon in which the non-sheet-feeding portions gradually rise in temperature (hereinafter, referred to as non-sheet-feeding portion temperature rise) occurs. If the temperature of the non-sheet-feeding portions becomes excessively high, the temperature has various influences on components in the apparatus. If print is performed on a large size sheet having a width larger than that of a small size sheet in a state where the non-sheet-feeding portion temperature rise occurs, a phenomenon called high-temperature offset may occur in regions corresponding to the non-sheet-feeding portions in the small size sheet.

As a configuration to prevent such non-sheet-feeding portion temperature rise, for example, Japanese Patent Application Laid-Open No. 2001-100558 discloses the following configuration. That is, a configuration that includes a plurality of heat generation members having different lengths and exclusively switches by a switch relay a heat generation member that supplies electric power, so as to selectively use a heat generation member having a length corresponding to a size of a recording material.

However, the size of the recording material does not necessarily match one of the lengths of the heat generation members, and there is a case where a recording material of an intermediate size of the heat generation members having the different length (hereinafter, referred to as an intermediate size sheet) is caused to pass a fixing nip portion. In such a case, a measure in which, for example, a sheet number of recording materials to pass (hereinafter, referred to as feeding sheet number) per unit time (hereinafter, referred to as throughput) is decreased to restrain occurrence of the non-sheet-feeding portion temperature rise. For that reason, there is a demand for restraining the occurrence of the non-sheet-feeding portion temperature rise without decreasing the throughput even for intermediate size sheets.

SUMMARY OF THE INVENTION

An aspect of the present invention is a fixing apparatus for performing fixing processing on an unfixed toner image on a recording material, including a heater including at least a first heat generation member and a second heat generation member having a length in a longitudinal direction shorter than a length of the first heat generation member in the longitudinal direction, a switching unit configured to switch a heat generation member to which electric power is supplied, to one of the first heat generation member and the second heat generation member, and a control unit configured to control the switching unit, wherein in a case where the fixing processing is performed continuously on recording materials having a width in the longitudinal direction shorter than a length of the first heat generation member in the longitudinal direction and longer than a length of the second heat generation member in the longitudinal direction, and wherein the control unit sets a timing to switch between the first heat generation member and the second heat generation member by the switching unit, based on information relating to a size of the recording materials.

Another aspect of the present invention is an image forming apparatus including an image forming unit configured to form an unfixed toner image on a recording material, and a fixing apparatus for performing fixing processing on an unfixed toner image on a recording material, including a heater including at least a first heat generation member and a second heat generation member having a length in a longitudinal direction shorter than a length of the first heat generation member in the longitudinal direction, a switching unit configured to switch a heat generation member to which electric power is supplied, to one of the first heat generation member and the second heat generation member, and a control unit configured to control the switching unit, wherein in a case where the fixing processing is performed continuously on recording materials having a width in the longitudinal direction shorter than a length of the first heat generation member in the longitudinal direction and longer than a length of the second heat generation member in the longitudinal direction, and wherein the control unit sets a timing to switch between the first heat generation member and the second heat generation member by the switching unit, based on information relating to a size of the recording materials, wherein the fixing apparatus fixes the unfixed toner image formed on the recording material by the image forming unit on the recording material.

Further features of the present invention will become apparent from the following description of exemplary embodiments with reference to the attached drawings.

DESCRIPTION OF THE EMBODIMENTS

Embodiments of the present invention will be described below with reference to the drawings. "Passing a recording paper through a fixing nip portion" is referred to also as feeding paper in the following Embodiments. In addition, regions of the fixing nip portion in the longitudinal direction where a small size sheet does not pass is referred to as non-sheet-feeding portions, and a phenomenon in which the non-sheet-feeding portions gradually rises in temperature is referred to as non-sheet-feeding portion temperature rise.

Embodiment 1

[Overall Structure]

Figure 1:
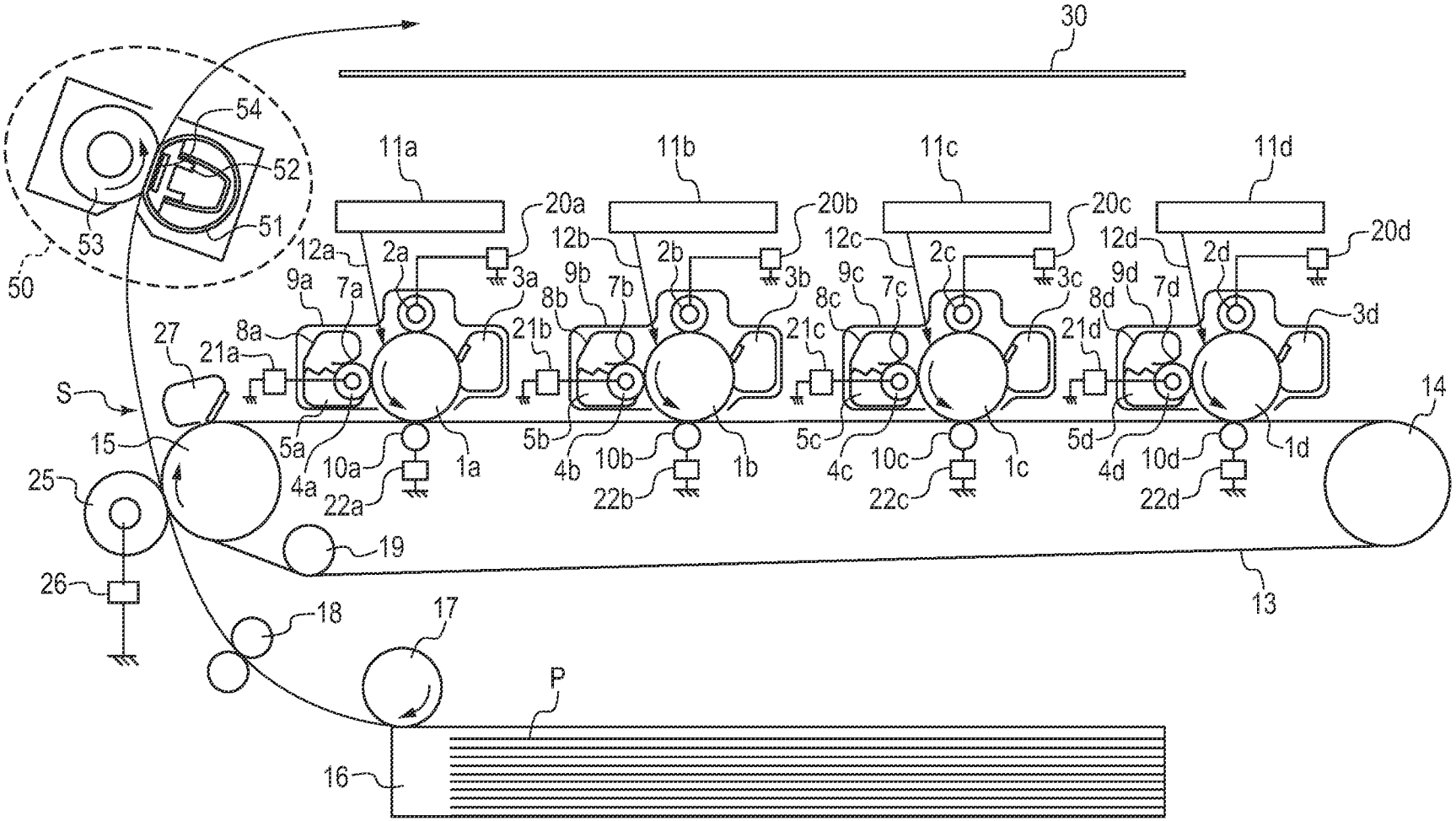
FIG. 1 is a general configuration diagram of an image forming apparatus in Embodiments 1 to 4.

FIG. 1 is a configuration diagram illustrating an in-line color image forming apparatus, which is an example of an image forming apparatus equipped with a fixing apparatus in Embodiment 1. With reference to FIG. 1, operation of an electrophotographic color image forming apparatus will be described. A first station is set as a station for forming a toner image of yellow (Y), and a second station is set as a station for forming a toner image of magenta (M). A third station is set as a station for forming a toner image of cyan (C), and a fourth station is set as a station for forming a toner image of black (K).

In the first station, a photosensitive drum 1*a* being an image bearing member is an organic photoconductor (OPC) photosensitive drum. The photosensitive drum 1*a* is made by stacking a plurality of layers of functional organic materials including a carrier generation layer that generates electrical charge when exposed to light, a charge transport layer that transports the generated electrical charge, and the like, on a metallic cylinder, where an outermost layer has such a low electric conductivity that the photosensitive drum 1*a* is substantially insulative. A charging roller 2*a* being a charging unit abuts against the photosensitive drum 1*a*, and as the photosensitive drum 1*a* rotates, the charging roller 2*a* follows the rotation to rotate, charging a surface of the photosensitive drum 1*a* uniformly. To the charging roller 2*a*, a DC voltage or a voltage superimposed on an AC voltage is applied, and the photosensitive drum 1*a* is charged by discharge occurring in a minute air gap upstream or downstream of a nip portion formed by the charging roller 2*a* and the surface of the photosensitive drum 1*a* in a rotating direction. A cleaning unit 3*a* is a unit that removes toner left on the photosensitive drum 1*a* after transfer described below. A developing unit 8*a* being a development unit is formed of a developing roller 4*a*, a nonmagnetic one-component toner 5*a*, and a developer application blade 7*a*. The photosensitive drum 1*a*, the charging roller 2*a*, the cleaning unit 3*a*, and the developing unit 8*a* form an integral process cartridge 9*a* that is attachable and detachable with respect to the image forming apparatus.

An exposure device 11*a* being an exposure unit is formed of a scanning unit that scans laser light with a polygon mirror or a light emitting diode (LED) array, and irradiates the photosensitive drum 1*a* with a scanning beam 12*a* modulated based on an image signal. The charging roller 2*a* is connected to a high voltage power supply for charge 20*a*, which is a voltage supply unit for the charging roller 2*a*. The developing roller 4*a* is connected to a high voltage power supply for development 21*a*, which is a voltage supply unit for the developing roller 4*a*. A primary transfer roller 10*a* is connected to a high voltage power supply for primary transfer 22*a*, which is a voltage supply unit for the primary transfer roller 10*a*. The first station has the configuration described above, and the second, third and fourth stations each have the same configuration. In the other stations, components having the same functions as those of the first station will be denoted by the same reference numerals, which are followed by b, c and d as indices for respective stations. In the following description, the indices a, b, c and d will be omitted except for cases where a specific station is described.

An intermediate transfer belt 13 is supported by three rollers, as its tensioning members, including a secondary transfer opposing roller 15, a tension roller 14, and an auxiliary roller 19. The tension roller 14 alone applies a force in a direction of stretching the intermediate transfer belt 13 using a spring, by which the intermediate transfer belt 13 keeps an appropriate force of tension. The secondary transfer opposing roller 15 receives rotary drive from a main motor (not illustrated) to rotate, causing the intermediate transfer belt 13 wound around an outer circumference of the secondary transfer opposing roller 15 to rotate. The intermediate transfer belt 13 moves in a forward direction (e.g., clockwise direction in FIG. 1) as opposed to the photosensitive drums 1*a* to 1*d* (e.g., rotating in a counterclockwise direction in FIG. 1) at a substantially the same speed as that of the photosensitive drums 1*a* to 1*d*. The intermediate transfer belt 13 rotates in an arrow direction (clockwise direction). The primary transfer roller 10 is disposed on an opposite side of the intermediate transfer belt 13 to the photosensitive drum 1 and follows the movement of the intermediate transfer belt 13 to rotate. A position at which the photosensitive drum 1 abuts against the primary transfer roller 10 across the intermediate transfer belt 13 is called a primary transfer position. The auxiliary roller 19, the tension roller 14, and the secondary transfer opposing roller 15 are electrically grounded. In the second to fourth stations, their primary transfer rollers 10*b* to 10*d* each have the same configuration as that of the primary transfer roller 10*a* of the first station and will not be described.

Next, image forming operation of the image forming apparatus in Embodiment 1 will be described. Upon receiving print instructions in a standby state, the image forming apparatus starts the image forming operation. The photosensitive drum 1, the intermediate transfer belt 13, and the like start rotating by their main motors (not illustrated) in the arrow directions at a predetermined process speed. In Embodiment 1, the process speed is, for example, 100 mm/s (millimeter per second). The photosensitive drum 1*a* is uniformly charged by the charging roller 2*a* to which voltage is applied by the high voltage power supply for charge 20*a*, and is subsequently irradiated with the scanning beam 12*a* from the exposure device 11*a*, by which an electrostatic latent image according to image information is formed on the photosensitive drum 1*a*. Toner 5*a* in the developing unit 8*a* is negatively charged by the developer application blade 7*a* and is applied to the developing roller 4*a*. Then, to the developing roller 4*a*, a predetermined development voltage is supplied from the high voltage power supply for development 21*a*. When the electrostatic latent image formed on the photosensitive drum 1*a* reaches the developing roller 4*a* as the photosensitive drum 1*a* rotates, the electrostatic latent image becomes visible by the negatively charged toner adhered to the electrostatic latent image, and thus a toner image of a first color (e.g., Y (yellow)) is formed on the photosensitive drum 1*a*. The stations of the other colors, M (magenta), C (cyan) and K (black), (process cartridges 9*b* to 9*d*) operate similarly. Electrostatic latent image made by exposure are formed on the photosensitive drums 1*a* to 1*d*, with drawing signals from a controller (not illustrated) being delayed with constant timings based on distances between primary transfer positions of the respective colors. To the respective primary transfer rollers 10*a* to 10*d*, high direct current voltages with a polarity opposite to that of toner are applied. Through the above-described process, toner images are transferred on the intermediate transfer belt 13 one by one (hereinafter, referred to as primary transfer), and a multiplexed toner image is formed on the intermediate transfer belt 13.

Thereafter, in synchronization with the formation of the toner image, a sheet P being one of recording materials loaded in a cassette 16 is fed (picked up) by a feeding roller 17 that is driven to rotate by a sheet feeding solenoid (not illustrated). The fed sheet P is conveyed to registration rollers 18 by a conveyance roller. The sheet P is conveyed to a transfer nip portion by the registration rollers 18 in synchronization with the toner image on the intermediate transfer belt 13, the transfer nip portion being an abutting portion of the intermediate transfer belt 13 and a secondary transfer roller 25. The registration rollers 18 are provided with a registration sensor (not illustrated) for sensing presence/absence of the sheet P. To the secondary transfer roller 25, a voltage with a reversed polarity to that of the toner is applied by the high voltage power supply for secondary transfer 26, which causes the multiplexed toner image of the four colors beard on the intermediate transfer belt 13 is collectively transferred to the sheet P (recording material) (hereinafter, referred to as secondary transfer). The members contribute to the formation of an unfixed toner image on the sheet P (e.g., the photosensitive drum 1) function as an image forming unit. After completion of the secondary transfer, toner left on the intermediate transfer belt 13 is removed by the cleaning unit 27. The sheet P after the completion of the secondary transfer is conveyed to a fixing apparatus 50 being a fixing unit, and with the toner image fixed thereto, the sheet P is discharged to a discharge tray 30 as an image formed matter (print, copy). The fixing apparatus 50 includes a film 51, a nip forming member 52, a pressing roller 53, and a heater 54, which will be described below. A sensor S is a sensor that is provided downstream of the fixing apparatus 50 in a conveyance direction of the sheet P and senses a passage of the sheet P.

In a print mode in which a plurality of sheets P are printed continuously (continuous job), the print is performed such that a toner image T on the intermediate transfer belt 13 and a sheet P are conveyed in synchronization with each other so that a distance between a trailing edge of a leading sheet P and a leading edge of a subsequent sheet P is equal to a setting value in each embodiment.

[Block Diagram of Image Forming Apparatus]

Figure 2:
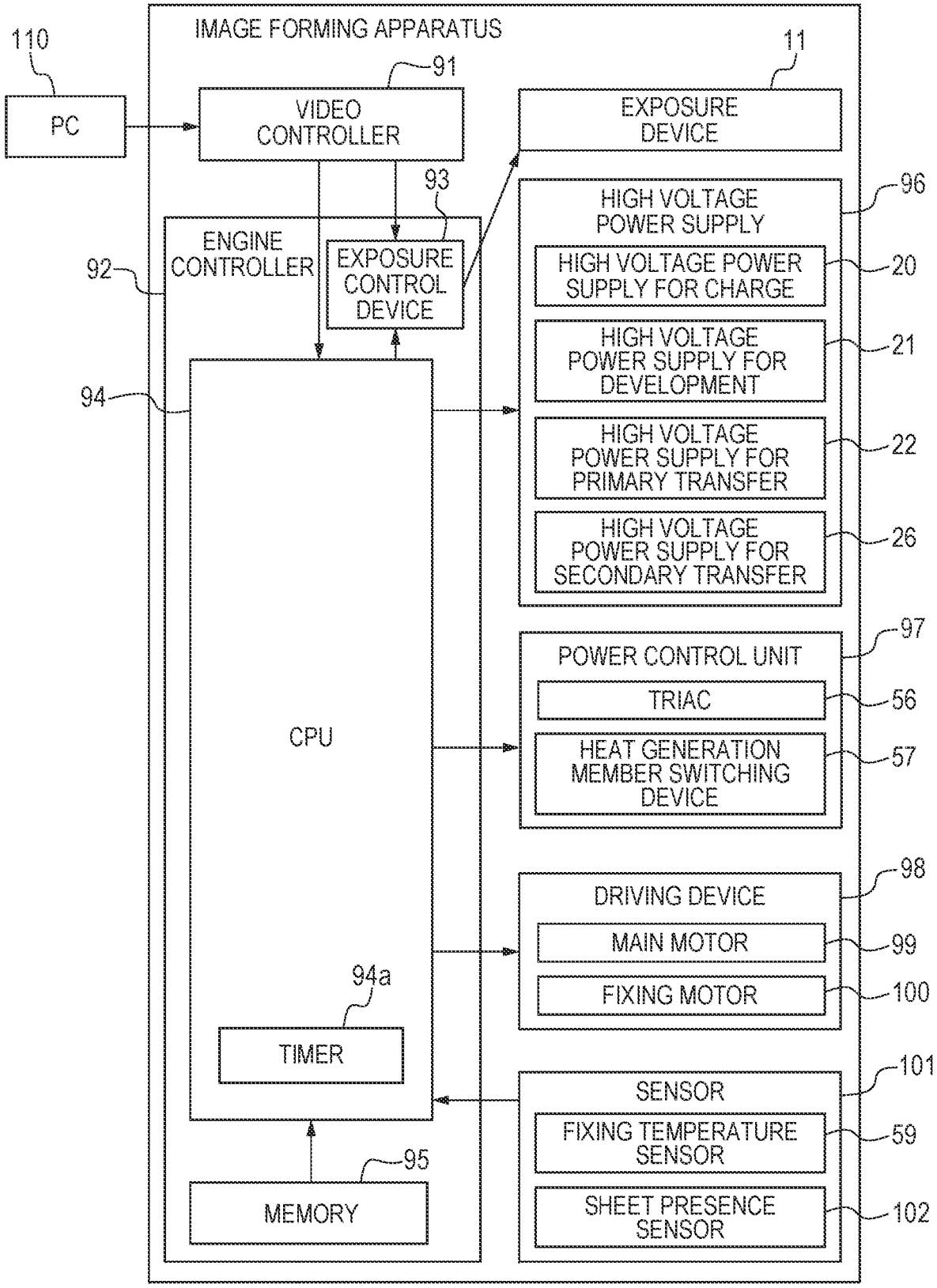
FIG. 2 is a control block diagram of the image forming apparatus in Embodiments 1 to 4.

FIG. 2 is a block diagram used for describing operation of the image forming apparatus. With reference to the drawing, print operation of the image forming apparatus will be described. A PC 110 being a host computer takes a role of outputting print instructions to a video controller 91 inside the image forming apparatus and transmitting image data on a print image to the video controller 91.

The video controller 91 converts the image data from the PC 110 into exposure data and transmits the exposure data to an exposure control device 93 in an engine controller 92. The exposure control device 93 is controlled by a CPU 94 to control the exposure device 11 according to on/off in the exposure data. Upon receiving the print instructions, the CPU 94 being a control unit starts an image forming sequence.

The engine controller 92 is equipped with the CPU 94, a memory 95, and the like and performs operations that are programmed in advance. The CPU 94 is assumed to have a timer 94*a*. The memory 95 stores information relating to switch timings for a heat generation member described below (Table 1 described below, etc.). A high voltage power supply 96 includes the high voltage power supply for charge 20, the high voltage power supply for development 21, the high voltage power supply for primary transfer 22, and the high voltage power supply for secondary transfer 26, which are previously described. A power control unit 97 includes a bidirectional thyristor (hereinafter, referred to as triac) 56, a heat generation member switching device 57 as a switching unit that exclusively selects a heat generation member to which electric power is to be supplied. The power control unit 97 selects a heat generation member that is to generate heat in the fixing apparatus 50 and determines an electric energy to supply. In Embodiment 1, the heat generation member switching device 57 is, for example, a C contact relay.

A driving device 98 includes a main motor 99, a fixing motor 100, and the like. A sensor 101 includes a fixing temperature sensor 59 that senses a temperature of the fixing apparatus 50, sheet presence sensors 102 each of which has a flag and senses presence/absence of a sheet P, and the like, and sensing results from the sensor 101 are sent to the CPU 94. The sensor S previously described is one of the sheet presence sensors 102. The CPU 94 acquires the sensing results from the sensor 101 in the image forming apparatus and controls the exposure device 11, the high voltage power supply 96, the power control unit 97, and the driving device 98. By forming an electrostatic latent image, transferring a developed toner image, fixing the toner image to a sheet P, and the like with these components, the CPU 94 controls an image forming process in which exposure data is printed on the sheet P in a form of the toner image. The image forming apparatus to which the present invention is applied is not limited to the image forming apparatus having the configuration described with reference to FIG. 1 but is any image forming apparatus that is capable of printing sheets P of different sizes continuously and includes the fixing apparatus 50 having the heater 54 described below (see FIG. 3, etc.).

[Fixing Apparatus]

Figure 3:
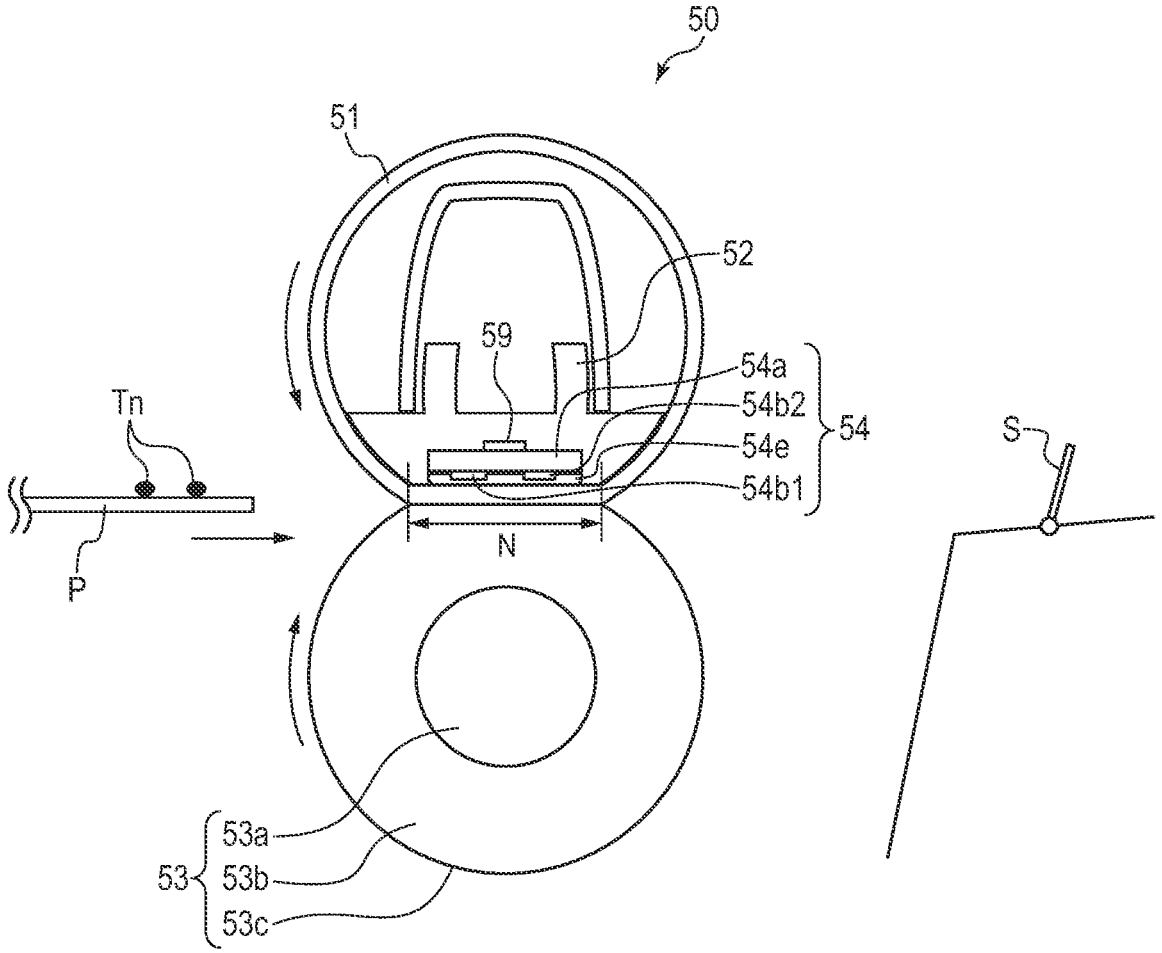
FIG. 3 is a cross-sectional schematic diagram of a fixing apparatus in Embodiments 1 to 3, illustrating a vicinity of a center portion of the fixing apparatus in its longitudinal direction.
Figure 4A:
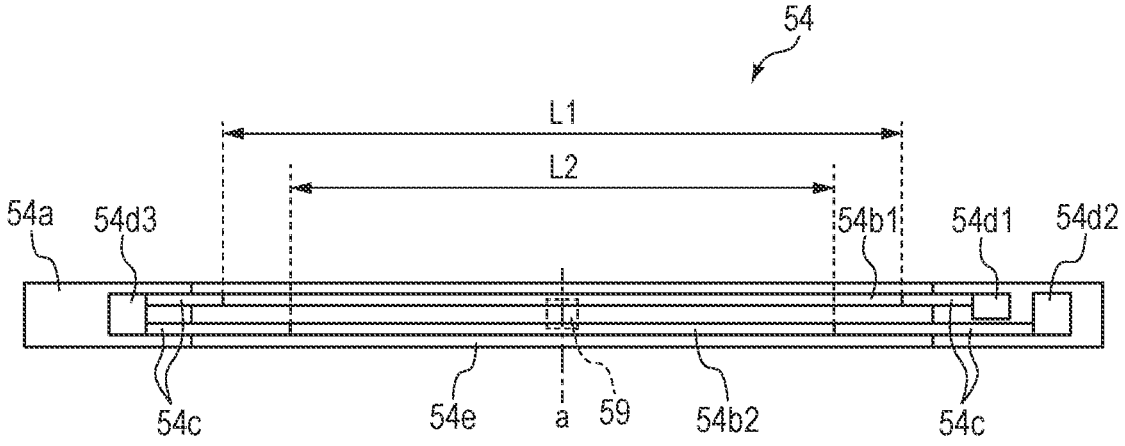
FIG. 4A is a schematic diagram of a heater in Embodiments 1 to 3.
Figure 4B:
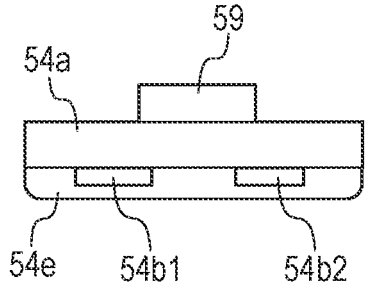
FIG. 4B is a cross-sectional view of the heater.
Figure 4C:
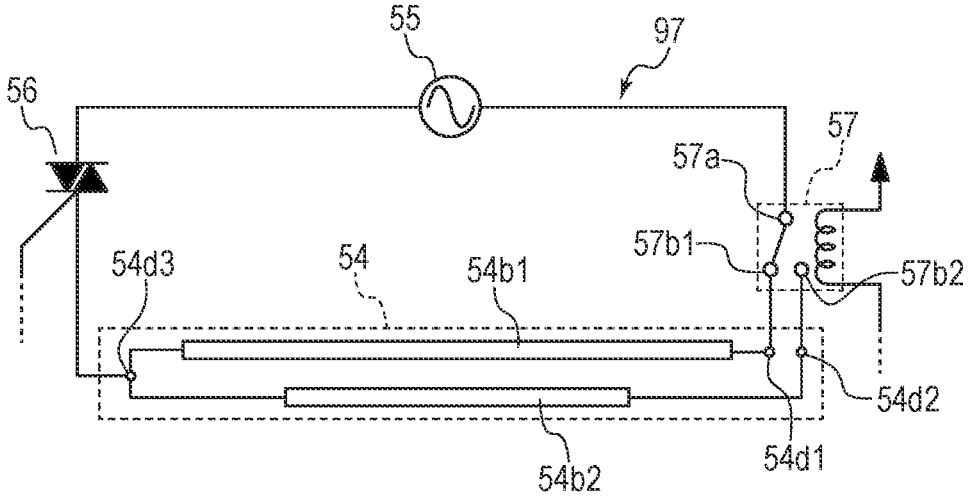
FIG. 4C is a schematic diagram of a power control unit of the fixing apparatus.

Next, a configuration of the fixing apparatus 50 in Embodiment 1 will be described with reference to FIG. 3, FIG. 4A, FIG. 4B, and FIG. 4C. Here, a longitudinal direction refers to a rotation axis direction of the pressing roller 53 that is substantially perpendicular to the conveyance direction of a sheet P described below. In addition, a width refers to a length of a sheet P in a direction that is substantially perpendicular to the conveyance direction (longitudinal direction). FIG. 3 is a cross-sectional schematic diagram of the fixing apparatus 50, FIG. 4A is a schematic diagram of the heater 54, FIG. 4B is a cross-sectional schematic diagram of the heater 54, and FIG. 4C is a circuit schematic diagram of the power control unit 97. FIG. 4B is a diagram illustrating a cross section of the heater 54 taken along a center line of heat generation members 54*b*1 and 54*b*2 in the longitudinal direction (line a illustrated as a dash-dot line in FIG. 4A).

A sheet P bearing an unfixed toner image Tn is conveyed from the left of FIG. 3 into a fixing nip portion N from the left to the right of the drawing to be heated, by which the toner image Tn is fixed to the sheet P. The fixing apparatus 50 in Embodiment 1 includes the cylindrical film 51 as a fixing film, the nip forming member 52 that retains the film 51, the pressing roller 53 that forms the fixing nip portion N together with the film 51, and the heater 54 that heats a sheet P.

The film 51 being a first rotary member is a fixing film as a heating rotary member. In Embodiment 1, the film 51 is formed of three layers including a base layer, an elastic layer, and a release layer. For the base layer, polyimide is used, for example. On the base layer, the elastic layer made of silicone rubber and the release layer made of PFA are used. A thickness of the base layer is, for example, 50 μm, a thickness of the elastic layer is, for example, 200 μm, and a thickness of the release layer is, for example, 20 μm. An outer diameter of the film 51 is, for example, 18 mm. To an inner surface of the film 51, grease is applied to reduce frictional force that occurs between the film 51, and the nip forming member 52 and the heater 54 due to rotation of the film 51.

The nip forming member 52 takes a role of guiding the film 51 on an inner side of the film 51, as well as forming the fixing nip portion N with the pressing roller 53 across the film 51. The nip forming member 52 is a member having rigidity, heat-resistant properties, and heat-insulation properties, and is formed of liquid crystal polymer, or the like. The film 51 is fitted over this nip forming member 52. The pressing roller 53 being a second rotary member is a roller as a pressing rotary member. The pressing roller 53 is a core 53*a* made of copper, an elastic layer 53*b* made of silicone rubber, and a release layer 53*c* made of PFA material. A diameter of the core 53*a* is, for example, 12 mm, a thickness of the elastic layer 53*b* is, for example, 3 mm, and a thickness of the release layer 53*c* is, for example, 50 μm. A diameter of the pressing roller 53 is, for example, 20 mm. The pressing roller 53 is held rotatably at its both ends and is driven to rotate by the fixing motor 100 (see FIG. 2). As the pressing roller 53 rotates, the film 51 follows the rotation to rotate. The heater 54 being a heating member is held by the nip forming member 52 and is in contact with the inner surface of the film 51. A substrate 54*a*, heat generation members 54*b*1 and 54*b*2, a protection glass layer 54*e*, and a fixing temperature sensor 59 will be described below.

(Heater)

The heater 54 will be described in detail with reference to FIG. 4A and FIG. 4B. The heater 54 includes the substrate 54*a* made of alumina, the heat generation members 54*b*1 and 54*b*2 made of silver paste, conductors 54*c*, contacts 54*d*1 to 54*d*3, and the protection glass layer 54*e* made of glass. On the substrate 54*a*, the heat generation members 54*b*1 and 54*b*2, the conductors 54*c*, and the contacts 54*d*1 to 54*d*3 are formed, on which the protection glass layer 54*e* is formed to secure insulation between the heat generation members 54*b*1 and 54*b*2, and the film 51. The heat generation member 54*b*1 and the heat generation member 54*b*2 will also be expressed as heat generation members 54*b* without distinction. The substrate 54*a* has a length (length in the lengthwise direction) of, for example, 250 mm, a width (length in a transverse direction) of, for example, 7 mm, and a thickness of, for example, 1 mm. Thicknesses of the heat generation members 54*b* and the conductor 54*c* are, for example, 10 μm, a thickness of the contacts 54*d* is, for example, 20 μm, and a thickness of the protection glass layer 54*e* is, for example, 50 μm.

The heat generation member 54*b*1 being a first heat generation member has a length in the longitudinal direction (hereinafter, referred to also as size) different from that of the heat generation member 54*b*2 being a second heat generation member. The heater 54 in Embodiment 1 includes at least the heat generation members 54*b*1 and 54*b*2. Specifically, the length in the longitudinal direction of the heat generation member 54*b*1 is L1, the length in the longitudinal direction of the heat generation member 54*b*2 is L2, and the length L1 and the length L2 satisfy a relation of L1>L2. The length L1 of the heat generation member 54*b*1 in the longitudinal direction is, for example, L1=222 mm. The length L2 of the heat generation member 54*b*2 in the longitudinal direction is, for example, L2=185 mm. Resistance values of the heat generation members 54*b*1 and 54*b*2 are set at, for example, 20Ω and 24Ω, respectively. The length L1 of the heat generation member 54*b*1 is set at a length that enables a sheet P having a largest width of sheets P that can be printed (or conveyed) by this image forming apparatus (hereinafter, referred to as maximum-sheet-feeding width) to be subjected to fixing. The heat generation member 54*b*1 is electrically connected to the contacts 54*d*1 and 54*d*3 via the conductors 54*c*, and the heat generation member 54*b*2 is electrically connected to the contacts 54*d*2 and 54*d*3 via the conductors 54*c*. That is, the contact 54*d*3 is a contact that is connected to the heat generation members 54*b*1 and 54*b*2 in common.

The fixing temperature sensor 59 is positioned on an opposite surface of the substrate 54*a* to the protection glass layer 54*e*, disposed at a center position a of the heat generation members 54*b*1 and 54*b*2 in the longitudinal direction, and pressed against the substrate 54*a* at 200 grams-force (gf). The fixing temperature sensor 59 is, for example, a thermistor, senses a temperature of the heater 54, and outputs a sensing result to the CPU 94. Based on the sensing result from the fixing temperature sensor 59, the CPU 94 controls the temperature in fixing processing. In Embodiment 1, the power control unit 97 performs the temperature control of the fixing apparatus 50 at, for example, 180° C.

(Power Control Unit)

FIG. 4C is a schematic diagram of the power control unit 97 being a control circuit for the fixing apparatus 50. The power control unit 97 for the fixing apparatus 50 includes the heat generation members 54*b*1 and 54*b*2 (the heater 54), an AC power supply 55, the triac 56, and the heat generation member switching device 57. The triac 56 is brought into conduction to supply electric power from the AC power supply 55 to the heat generation members 54*b*1 and 54*b*2, and is brought out of conduction to cut off the supply of the electric power from the AC power supply 55 to the heat generation members 54*b*1 and 54*b*2. The triac 56 functions as a connecting unit that connects or cuts off the supply of the electric power to the heater 54. Based on temperature information, the sensing result from the fixing temperature sensor 59, the CPU 94 calculates an electric power necessary to control the heat generation members 54*b*1 and 54*b*2 to a target temperature (e.g., 180° C. previously described) and performs control to bring the triac 56 into or out of conduction.

The heat generation member switching device 57 is, for example, a C contact relay in Embodiment 1. Specifically, the heat generation member switching device 57 includes a contact 57*a* connected to the AC power supply 55, a contact 57*b*1 connected to the contact 54*d*1, and a contact 57*b*2 connected to the contact 54*d*2. The heat generation member switching device 57 assumes one of a state where the contact 57*a* is connected to the contact 57*b*1 and a state where the contact 57*a* is connected to the contact 57*b*2, under control by the CPU 94. Switching of the heat generation member switching device 57 causes exclusive selection of whether to supply electric power to the heat generation member 54*b*1 or the 54*b*2. That is, the heat generation member switching device 57 switches the heater 54 to one of the heat generation member 54*b*1 and the heat generation member 54*b*2. The heat generation member switching device 57 performs the switching upon receiving a signal from the CPU 94. To prevent the contacts from fusing in the heat generation member switching device 57 being a C contact relay, the switching of the heat generation member switching device 57 is performed in a state where the triac 56 is out of conduction (state where power supply to the heat generation member 54*b*1 or the heat generation member 54*b*2 is cut off).

[Switch Operation of Heat Generation Member]

In Embodiment 1, switching between the heat generation members 54*b* is performed during a sheet interval time period. Here, the sheet interval time period refers to as a time period from a time point at which a trailing edge of a leading sheet P (first recording material) passes the fixing nip portion N until a time point at which a leading edge of a sheet P continuously passing the fixing nip portion N subsequently to the sheet P (second recording material) enters the fixing nip portion N. In addition, a sheet interval refers to as a distance between the trailing edge of the leading sheet P and the leading edge of the subsequent sheet P. Operation to switch from the heat generation member 54*b*1 to the heat generation member 54*b*2 during the sheet interval time period will be described below.

The CPU 94 acquires a time at which the leading edge of the leading sheet P passes the sensor S provided downstream of the fixing nip portion N, based on a sensing result from the sensor S. Based on the time at which the leading edge of the leading sheet P passes the sensor S, a length of the sheet P in the conveyance direction, and the process speed, the CPU 94 calculates a timing t1 at which the trailing edge of this sheet P passes the fixing nip portion. The CPU 94 refers to the timer 94*a*, and at the timing t1 at which the trailing edge of the leading sheet P passes the fixing nip portion N, in other words, at a time when the sheet interval time period comes, the CPU 94 turns off the triac 56 using the power control unit 97 to cut off the supply of electric power to the heat generation member 54*b*1.

At a timing t2 at which 20 ms elapses from the timing t1, the CPU 94 uses the power control unit 97 to send a signal for switching between the heat generation members 54*b* to the heat generation member switching device 57. Then, at a timing t3 at which another 200 ms elapses from the timing t2, switching from the heat generation member 54*b*1 to the heat generation member 54*b*2 by the heat generation member switching device 57 is completed. At a timing t4 at which 100 ms elapses from the timing t3, the CPU 94 uses the triac 56 to start the supply of electric power to the heat generation member 54*b*2. Here, 100 ms is provided between the timing t3 and the timing t4 to avoid fusion of the contacts in the heat generation member switching device 57 reliably even when an error occurs in an operating time of the heat generation member switching device 57. A total time from the timing t1 to the timing t4 is 320 ms (=20 ms+200 ms+100 ms), and this time is set to fall within the sheet interval time period. This is because the time from the timing t1 to the timing t4 being longer than the sheet interval time period causes the following phenomenon. That is, this disables the heat generation member 54*b*2 to heat the leading end of the subsequent sheet P and its vicinity until the timing t4, which may bring about a poor fixing in the subsequent sheet P.

Here, sheets P having widths (hereinafter, referred to as paper width) equal to or shorter than a length of the heat generation member 54*b*1 in the longitudinal direction (hereinafter, referred to as width) and equal to or longer than a width of the heat generation member 54*b*2 are referred to as intermediate size sheets. Of the intermediate size sheets, sheets P having paper widths equal to or longer than a paper width of A4 size, 210 mm (A4 size, letter (LTR) size, legal (LGL) size, etc.) are referred to as large size sheets. Sheets P having widths shorter than the width of the heat generation member 54*b*2 will be referred to as small size sheets.

[Printing Operation]

Figure 5:
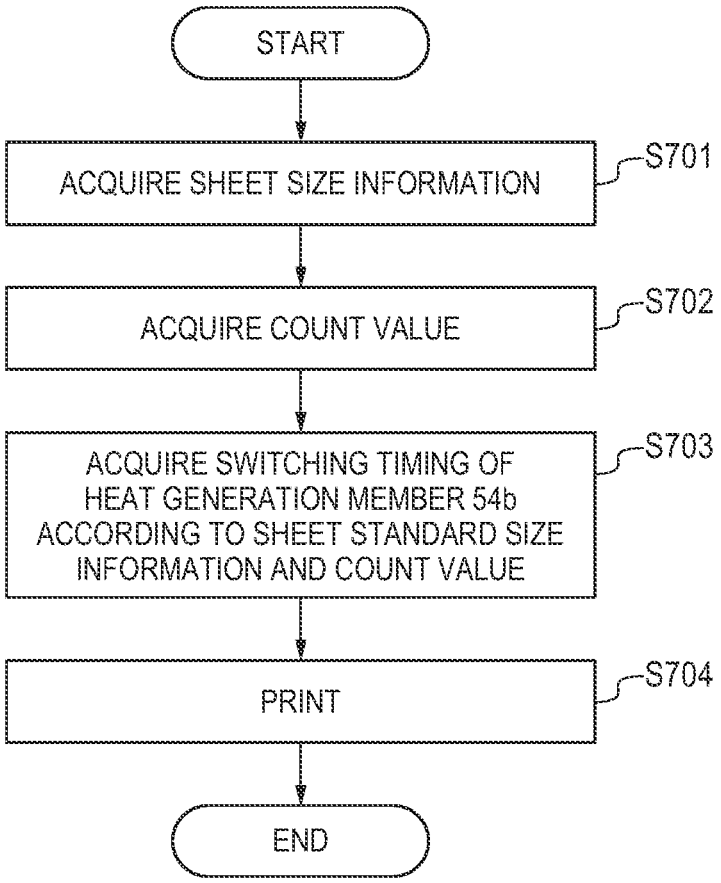
FIG. 5 is a flowchart illustrating print processing in Embodiment 1.

FIG. 5 illustrates a sequence of the CPU 94 from receiving a print command to finishing print. In Embodiment 1, a switch timing of the heat generation members 54*b* based on sheet size information on a sheet P and a count value described below. The sheet size information in Embodiment 1 is information on standard sizes of sheets P input in the PC 110 (hereinafter, referred to as standard size information).

Upon receiving the print command, the CPU 94 executes a process including step (hereinafter, abbreviated to S) 701 and its subsequent steps. In S701, the CPU 94 acquires sheet size information on a sheet P, that is, the standard size information in Embodiment 1, from the PC 110. In S702, the CPU 94 acquires a count value described below. In S703, according to the sheet size information acquired in S701 (the standard size information in Embodiment 1) and the count value acquired in S702, the CPU 94 refers to Table 1 described below showing switch timings of the heat generation member 54*b* and acquires the switch timing of the heat generation member 54*b*. In S704, the CPU 94 performs print on the sheet P while controlling the heater 54 according to the switch timing of the heat generation member 54*b* acquired in S703. Note that the print here means print performed continuously on a plurality of sheets P.

(Switch Timing of Heat Generation Member 54*b*)

In S703, the CPU 94 acquires the following information when causing large size sheets, intermediate size sheets, and small size sheets selected through the sequence of FIG. 5 to pass the fixing nip portion N, in other words, when performing the fixing processing on the sheets P. That is, the CPU 94 acquires switch timings of the heat generation member 54*b* in the fixing processing on a plurality of sheets P, by referring to information of Table 1 stored in the memory 95.

TABLE 1

| Size classification of sheet | Name of standard size sheet | Sheet size Width W (mm) | Sheet size Length Z (mm) | Sheet number for which the heat generation member 54b1 is forcibly used to perform print when the print is started from the cold state | Ratio of sheet numbers for which electric power is supplied: Zone 1 Heat generation member 54b1 | Zone 1 Heat generation member 54b2 | Zone 2 Heat generation member 54b1 | Zone 2 Heat generation member 54b2 |
|---|---|---|---|---|---|---|---|---|
| Large size sheet | LTR | 216 | 279 | 3 | 1 | — | 1 | — |
| | A4 | 210 | 297 | 3 | 1 | — | 1 | — |
| Intermediate size sheet | 16K | 195 | 267 | 3 | 5 | 1 | 4 | 1 |
| Small size sheet | B5 | 176 | 250 | 3 | — | 1 | — | 1 |
| | A5 | 148 | 210 | 3 | — | 1 | — | 1 |

Table 1 is a table showing a list that includes typical standard size sheets including the large size sheet, the intermediate size sheet, and the small size sheet, and includes ratios of sheet numbers for which electric power is supplied to the heat generation member 54*b*1 or the heat generation member 54*b*2. In Table 1, its first column shows size classification of sheets P (large size sheet, etc.), its second column shows names of the standard size sheets (A4, etc.), and its third column shows sizes of the sheets P (e.g., for A4, width W=210 mm and length Z=297 mm). A fourth column of Table 1 shows a predetermined sheet number (e.g., three for A4) for which the heat generation member 54*b*1 is forcibly used to perform the print in a case where the print is started from a cold state. The cold state refers to a case where the count value described below is less than a first target count value (predetermined value) (being less than the predetermined value) at a time of starting the print. A state where the count value is equal to or greater than the first target count value (being equal to or greater than the predetermined value) is referred to as a hot state. A fifth column of Table 1 shows ratios of sheet numbers for which electric power is supplied, and these ratios are categorized into a zone 1 and a zone 2. For each zone, the fifth column shows a ratio between sheet numbers for which the heat generation member 54*b*1 and the heat generation member 54*b*2 are used. For example, in a case of the intermediate size sheet and the zone 1, a ratio between the heat generation member 54*b*1 and the heat generation member 54*b*2 is 5 to 1. This shows a process including fixing processing on five sheets P using the heat generation member 54*b*1 and subsequent fixing processing on one sheet P using the heat generation member 54*b*2 is repeated. Information shown in Table 1, that is, information on switch control of the heat generation members 54*b* based on the sheet size information and the count value, in other words, information on patterns of which of the heat generation members 54*b* is used to how many sheets P will be referred to as heat generation member patterns. In Table 1, a sheet number of the sheets P on which the fixing processing is performed using the heat generation member 54*b*1 in a case where the count value is equal to or greater than the first target count value is set to be less than that in a case where the count value is less than the first target count value.

As shown in the row regarding the large size sheet in Table 1, a column of ratio showing "1" for the heat generation member 54*b*1 and "-" for the heat generation member 54*b*2 indicates that print is performed using only the heat generation member 54*b*1 and print using the heat generation member 54*b*2 is not performed. Regarding the intermediate size sheet, a column of ratio showing "5" for the heat generation member 54*b*1 and "1" for the heat generation member 54*b*2 (Zone 1) indicates that print is performed on five sheets using only the heat generation member 54*b*1 and print is performed on one sheet using only the heat generation member 54*b*2.

For the small size sheet, the column of ratio shows "-" for the heat generation member 54*b*1 and "1" for the heat generation member 54*b*2. Here, regarding the small size sheet, "-" is set for the heat generation member 54*b*1, which means that, in a case where print is started from the cold state, the heat generation member 54*b*1 is forcibly used to perform the print on first three sheets and then the print is performed using only the heat generation member 54*b*2. A reason for performing the print on the first three sheets forcibly using the heat generation member 54*b*1 is as follows. That is, in this manner, the heat generation member 54*b*1 transmits heat to an entire region of the fixing nip portion N in the longitudinal direction uniformly, so as to uniformly soften the grease on the inner surface of the film 51. This prevents the film 51 from deforming due to unevenness in sliding load between the film 51 and the heater 54. A reason for using the heat generation member 54*b*2 for a fourth small size sheet onward is to suppress occurrences of the non-sheet-feeding portion temperature rise as much as possible and to increase a production speed for small size sheets by using the heat generation member 54*b*2 having a smaller non-sheet-feeding portion than the heat generation member 54*b*1 having a larger non-sheet-feeding portion.

Thereafter, a case where the CPU 94 determines that a sheet P is of the intermediate size sheet will be described.

The intermediate size sheet used in Embodiment 1 is a sheet P of 16K size (195 mm wide, 267 mm long). From a viewpoint of preventing the deformation of the film 51 previously described, the heat generation member 54*b*1 is forcibly used to perform print on three sheets for all of the standard size sheets in a case where the print is performed from the cold state. To perform print on intermediate size sheets, a switch timing of heat generation members 54*b* are set for each of the zone 1 and the zone 2. For example, in the zone 1, the heat generation member 54*b*1 is used to perform the fixing processing on five intermediate size sheets, and then the heat generation member 54*b*2 is used to perform the fixing processing on one intermediate size sheet. For example, in the zone 2, the heat generation member 54*b*1 is used to perform the fixing processing on four intermediate size sheets, and then the heat generation member 54*b*2 is used to perform the fixing processing on one intermediate size sheet.

[Continuous Print Using Switch Timing in Table 1]

Figure 6:
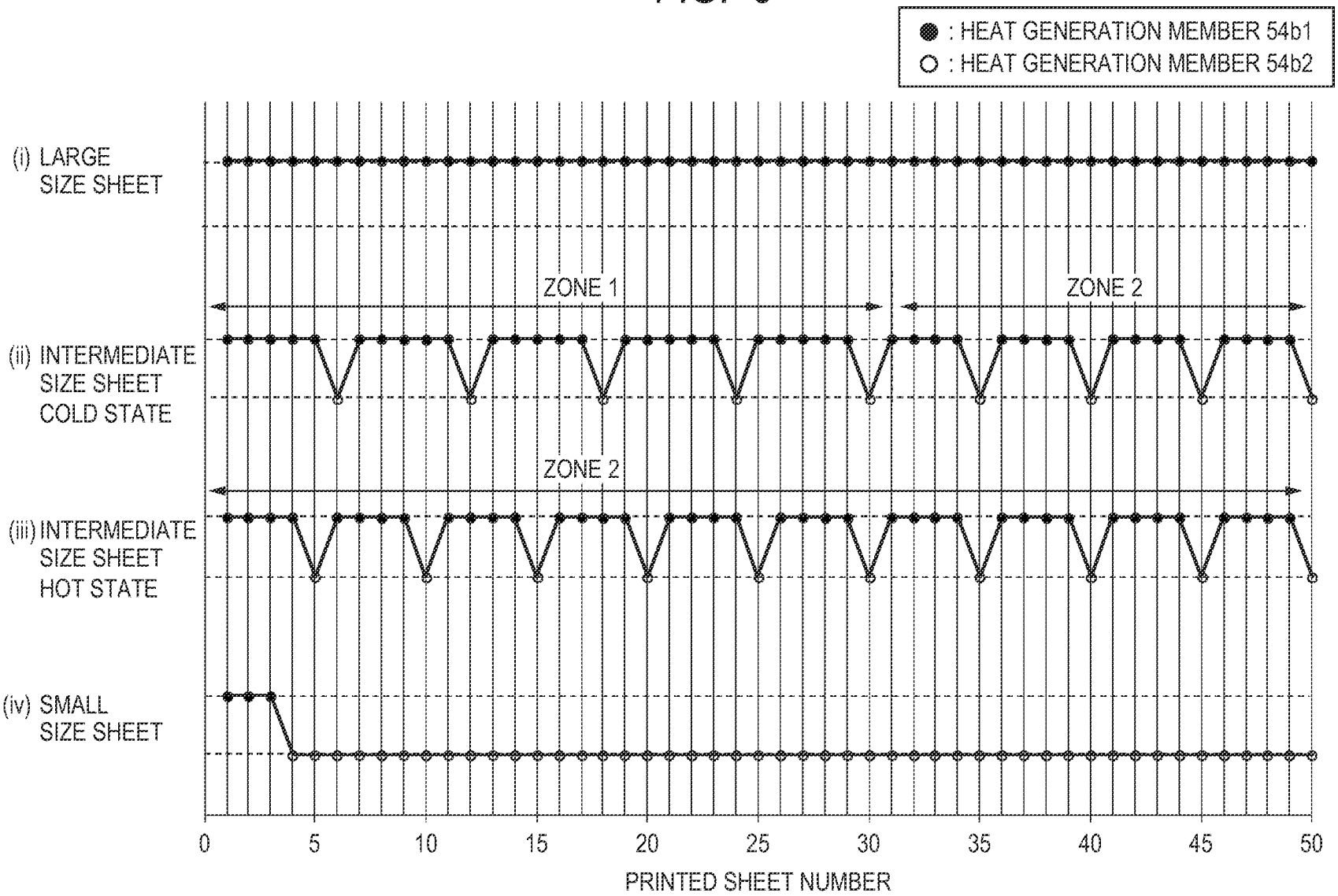
FIG. 6 is a graph illustrating switch timings of a heat generation member 54*b* in Embodiment 1.

FIG. 6 is a graph illustrating switch operation for the heat generation members 54*b* in a case where the CPU 94 refers to Table 1 to perform continuous print. In FIG. 6, (i) illustrates a case where the continuous print is performed on large size sheets. In FIG. 6, (ii) and (iii) illustrate a case where the continuous print is performed on intermediate size sheets, where (ii) illustrates a case where the print is started from the cold state, and (iii) illustrates a case where the print is started from the hot state. In FIG. 6, (iv) illustrates a case where the continuous print is performed on small size sheets. In any case, black dots each indicate that the heat generation member 54*b*1 is used, white dots each indicate that the heat generation member 54*b*2 is used, and horizontal axes each indicate a printed sheet number.

Next, a count prediction system and zones will be described. In Embodiment 1, a count prediction system to predict temperatures of members of the fixing apparatus 50 (the film 51, the pressing roller 53, the nip forming member 52, etc.) is adopted. The count value is incremented by +1 every time the fixing processing is performed on one sheet P, and the count value increases with an increase in sheet number of sheet P subjected to the fixing processing. In contrast, in a standby state after fixing processing of the continuous print is ended, the count value is also decremented with time as the members of the fixing apparatus 50 are cooled down naturally. Specifically, the members of the fixing apparatus 50 are investigated in advance regarding their cooling properties, and the count value is decremented using an arithmetic expression that is a function of elapsed time. While the fixing processing is performed continuously on sheets P, the count value increases according to a sheet number of the sheets P, and after the fixing processing fixing processing continuously performed is ended, the count value is counted such that the count value decreases according to a drop in temperature of the heater 54. As seen from the above, management of the count value enables the temperatures of the members of the fixing apparatus 50 to be predicted. The management of the count value is performed by the CPU 94. As previously described, the count value is used for determining between the cold state and the hot state as well as for determination between the zone 1 and the zone 2 described below.

In Embodiment 1, the zone 1 refers to a zone from a count value of zero to the first target count value, the zone 2 refers to a zone from the first target count value to the second target count value, and a switch frequency of the heat generation members 54*b* (a ratio in Table 1) is changed for each zone. Note that a number of the zones is not necessarily limited to two and a plurality of zones may be provided. In Embodiment 1, the first target count value is set at, for example, 30, and a second target count value is set at, for example, 100. In a case where print is started from the cold state (the count value is zero), the count value reaches 30, which is the first target count value, at a time when 30 sheets are subjected to the print. Therefore, the zone 1 ends at the 30th sheet and is switched to the zone 2 from a 31st sheet onward. That is, when the count value reaches the first target count value, the CPU 94 determines that the non-sheet-feeding portion temperature rise has reached a high temperature, and switches from the heat generation member 54*b*1 to the heat generation member 54*b*2.

In FIG. 6, 50 sheets in total are subjected to the print, and at a time when a sheet number of sheets P subjected to the print reaches 50, the count value is 50 and does not reach 100 being the second target count value, and thus the print is ended in the zone 2. In a case where a sheet number of the continuous print exceeds 100, the zone 2 ended at a timing when the count value reaches 100, the second target count value, in other words, at a 100th sheet, and the zone 1 is switched to again from 101st sheet. That is, when the count value reaches second target count value, the CPU 94 determines that the temperature rise of the non-sheet-feeding portions have settled down, and switches from the heat generation member 54*b*2 to the heat generation member 54*b*1 again.

In contrast, there are different switch timings for a case where the count value before print on the intermediate size sheets is started is less than 30, that is, a case of the cold state, and for a case where the count value is equal to or greater than 30, that is, a case of the hot state. A reason for this is that a surface temperature of the non-sheet-feeding portions of the film 51 in the hot state tends to be high as compared with the cold state, and thus it is necessary to suppress the non-sheet-feeding portion temperature rise by making switching the heat generation members 54*b* more frequency in the hot state than the cold state. In the case of (iii) of FIG. 6, the hot state, the zone 2 is determined because the count value is equal to or greater than 30 before the print is started, and the print is performed at a switch timing of the heat generation members 54*b* for the zone 2. In (iii) of FIG. 6, assuming that the count value before the print is started is, for example, 30, performing the continuous print on another 50 sheets increases the count value to 80, which is less than 100 being the second target count value, and thus the continuous print ends in the zone 2.

(Printing 50 Sheets of Intermediate Size)

In Embodiment 1, a case of printing 50 sheets from the cold state will be described. As illustrated in (ii) of FIG. 6, in the zone 1 in the cold state, the print is performed in such a sequence that prints five sheets using the heat generation member 54*b*1, then prints one sheet after switching to the heat generation member 54*b*2, and switches to the heat generation member 54*b*1 again. The count value being equal to or greater than 30 means that the count value is equal to or greater than the first target count value, and thus the zone 1 is switched to the zone 2. Subsequently, in the zone 2, sheets up to a 50th sheet are printed in such a sequence that prints four sheets using the heat generation member 54*b*1, then prints one sheet after switching to the heat generation member 54*b*2, and switches to the heat generation member 54*b*1 again. In the hot state illustrated in (iii) of FIG. 6, sheets up to a 50th sheet are printed in the sequence for the zone 2 from a start of the print. In Embodiment 1, the sheet interval time period is set at 450 ms, and intermediate size sheets of 16K size are printed at a production speed of 19 sheets per minute.

Figure 7:
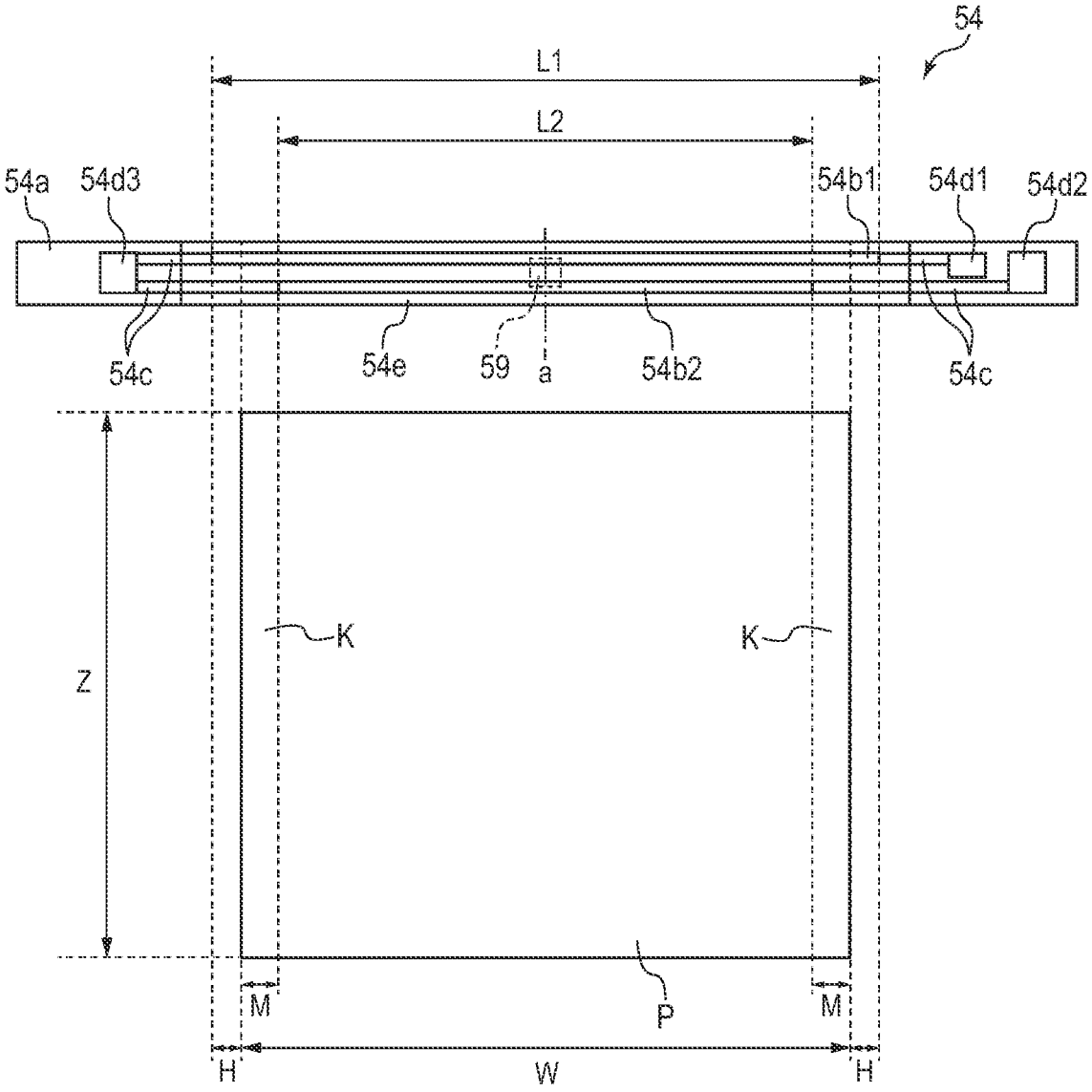
FIG. 7 is a diagram illustrating a positional relationship between the heater and a sheet in the longitudinal direction in Embodiment 1.

FIG. 7 is a diagram illustrating a positional relationship between the heater 54 and a sheet P in the longitudinal direction. In particular, the sheet P of 16K size (width W=195 mm, length Z=267 mm) is illustrated as a sheet P of the intermediate size sheet. In Embodiment 1, the heat generation member 54*b*1 has a length L1=222 mm, and the sheet P has a width W=195 mm, which causes the non-sheet-feeding portion temperature rise to occurs in regions having a width H=13.5 mm at both end portions of the heat generation member 54*b*1. The width H is a width of the non-sheet-feeding portions and is hereinafter referred to as a non-sheet-feeding portion width H.

Figure 8:
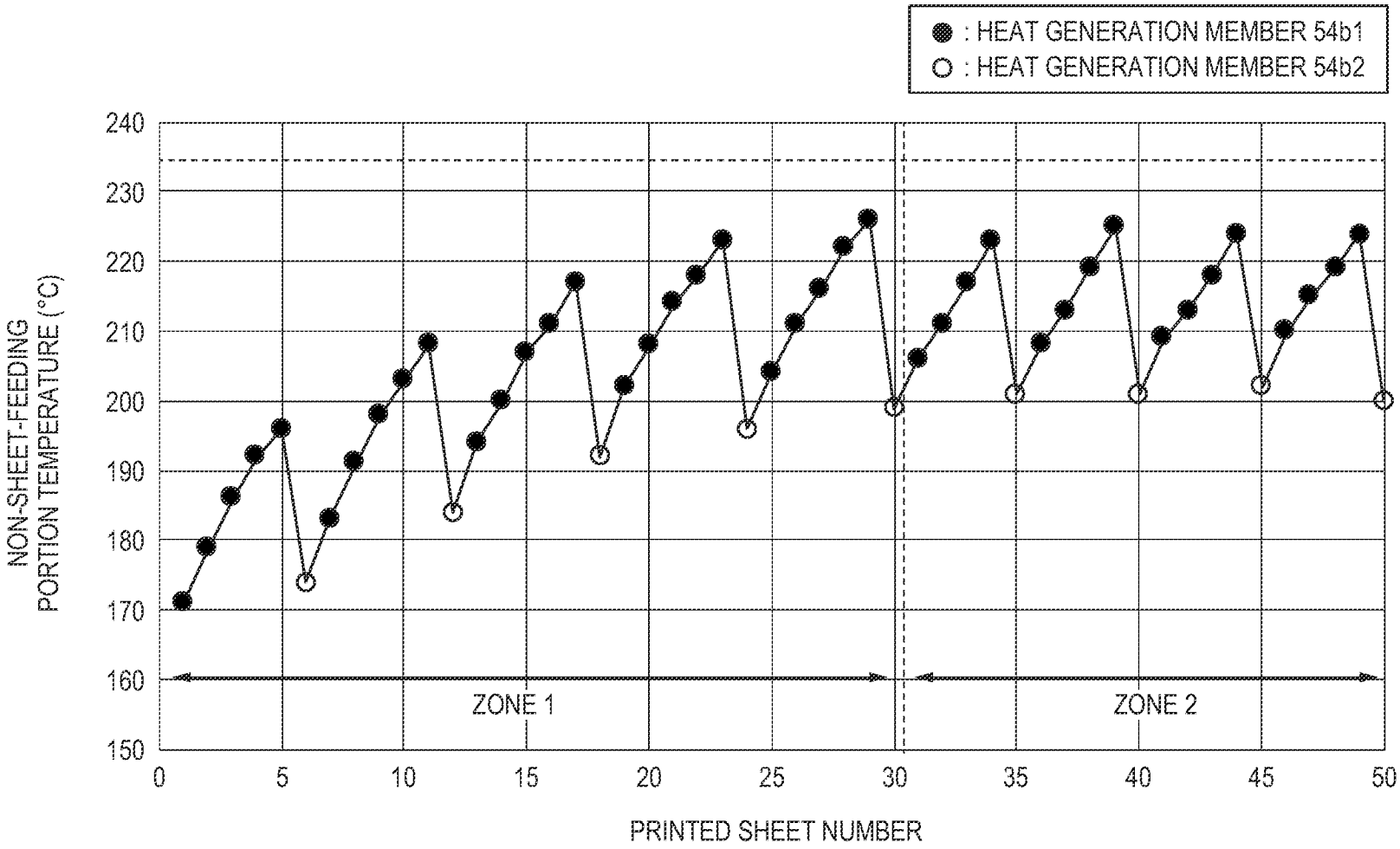
FIG. 8 is a graph illustrating a relationship between a printed sheet number and a non-sheet-feeding portion temperature in Embodiment 1.

FIG. 8 is a graph made by measuring, using a thermoviewer, a maximum temperature of surfaces of the film 51 corresponding to positions of the width H of FIG. 7 at which the non-sheet-feeding portion temperature rise occurs and plotting the maximum temperature for each printed sheet number, in the case of (ii) of FIG. 6 where printing the intermediate size sheets is started from the cold state. Black dots each indicate that the heat generation member 54*b*1 is used, and white dots each indicate that the heat generation member 54*b*2 is used. In FIG. 8, its horizontal axis indicates the printed sheet number, and its vertical axis indicates the non-sheet-feeding portion temperature (° C.). For a first sheet to a fifth sheet, the heat generation member 54*b*1 is used, and thus the non-sheet-feeding portion temperature rise occurs in the non-sheet-feeding portion widths H, increasing the temperature up to about 196° C. on the fifth sheet. Then, for a sixth sheet, only the heat generation member 54*b*2 is used. In FIG. 7, the length L2 of the heat generation member 54*b*2 is L2=185 mm, and the width W of the sheet P is W=195 mm, and thus end portions of the heat generation member 54*b*2 are shorter than end portions of the sheet P by M=5 mm. Hereinafter, M is referred to as non-heat width M. Therefore, there are no non-sheet-feeding portions of the heat generation member 54*b*2, and thus the non-sheet-feeding portion temperature rise does not occur at the sixth sheet.

In addition, in regions K at both end portions of the sheet P illustrated in FIG. 7, there are regions where the heat generation member 54*b*2 cannot heat the sheet P directly (hereinafter, referred to as non-heat regions K). As seen from the above, since the non-heat regions K appear in printing the sixth sheet, heat generated due to the non-sheet-feeding portion temperature rise occurring up to the fifth sheet in the regions of the widths H is conducted to the non-heat regions K of the sheet P by the film 51, the pressing roller 53, the heater 54, and the like. A temperature of the regions of the widths H can be thereby lowered. As a result, by causing the sixth sheet to pass the fixing nip portion N, the temperature of the non-sheet-feeding portions in the film 51 can be lowered to about 174° C. as illustrated in FIG. 8. Although the non-heat regions K cannot be heated directly by the heat generation member 54*b*2, good fixing properties can be obtained also in the non-heat regions K of the sheet P by using the heat of the non-sheet-feeding portion temperature rise occurring in the widths H, as previously described. Thereafter, sheets up to a 50th sheet are printed under the control previously described, a maximum temperature of the non-sheet-feeding portions in the film 51 can be suppressed to about 226° C. and can be made to fall below 235° C. (a broken line in FIG. 8), which is a target temperature for preventing breakage of the film 51.

As described above, performing the control in Embodiment 1 can suppress the non-sheet-feeding portion temperature rise while ensuring good fixing properties, which enables 50 16K-size sheets being the intermediate size sheets to be printed continuously at a production speed as high as 19 sheets per minute. Therefore, a time taken to continuously print the 50 intermediate size sheets was about 156 seconds.

Comparison Example 1

Figure 9:
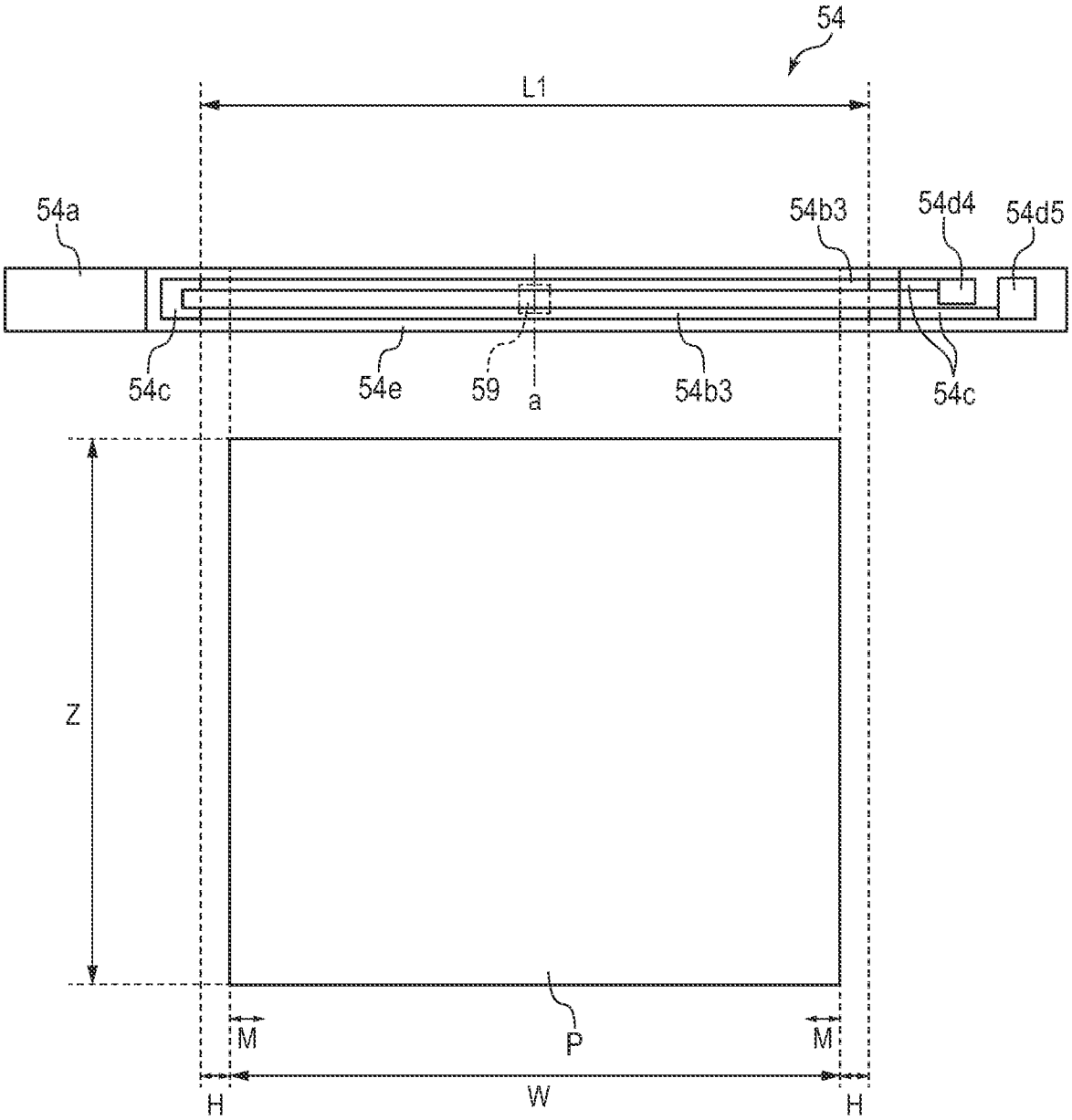
FIG. 9 is a diagram illustrating a positional relationship between a heater and a sheet in the longitudinal direction in Comparison Example of Embodiment 1.

A configuration of an image forming apparatus applied in Comparison Example 1 will be described with the same components in Embodiment 1 denoted by the same reference characters. FIG. 9 is a diagram illustrating a positional relationship between a heater 54 used in Comparison Example 1 and a sheet P in the longitudinal direction. The heater 54 used in the Comparison Example 1 has a basic configuration conventionally used, in which two heat generation members 54*b*3 has a length L1=222 mm, which is the same as that of the heat generation member 54*b*1 in Embodiment 1. The two heat generation members 54*b*3 are connected electrically in series by conductors 54*c*. The two heat generation members 54*b*3 generates heat by supply of electric power to between a contact 54*d*4 and a contact 54*d*5. Assume that the two heat generation members 54*b*3 electrically connected in series have a total resistance value of 20Ω.

In Comparison Example 1, a case where only the heat generation members 54*b*3 are used to continuously print 50 16K-size sheets as in Embodiment 1 will be described. In Comparison Example 1, the length of the heat generation members 54*b*3 is set as L1=222 mm as in Embodiment 1. Therefore, the non-sheet-feeding portion temperature rise occurs in the regions of the widths H=13.5 mm as in Embodiment 1 since the width W of the 16K-size sheet is set as width W=195 mm. In Comparison Example 1, note that there are no non-heat widths M because there is no heat generation member having a width smaller than that of the heat generation members 54*b*3, such as the heat generation member 54*b*2.

Figure 10:
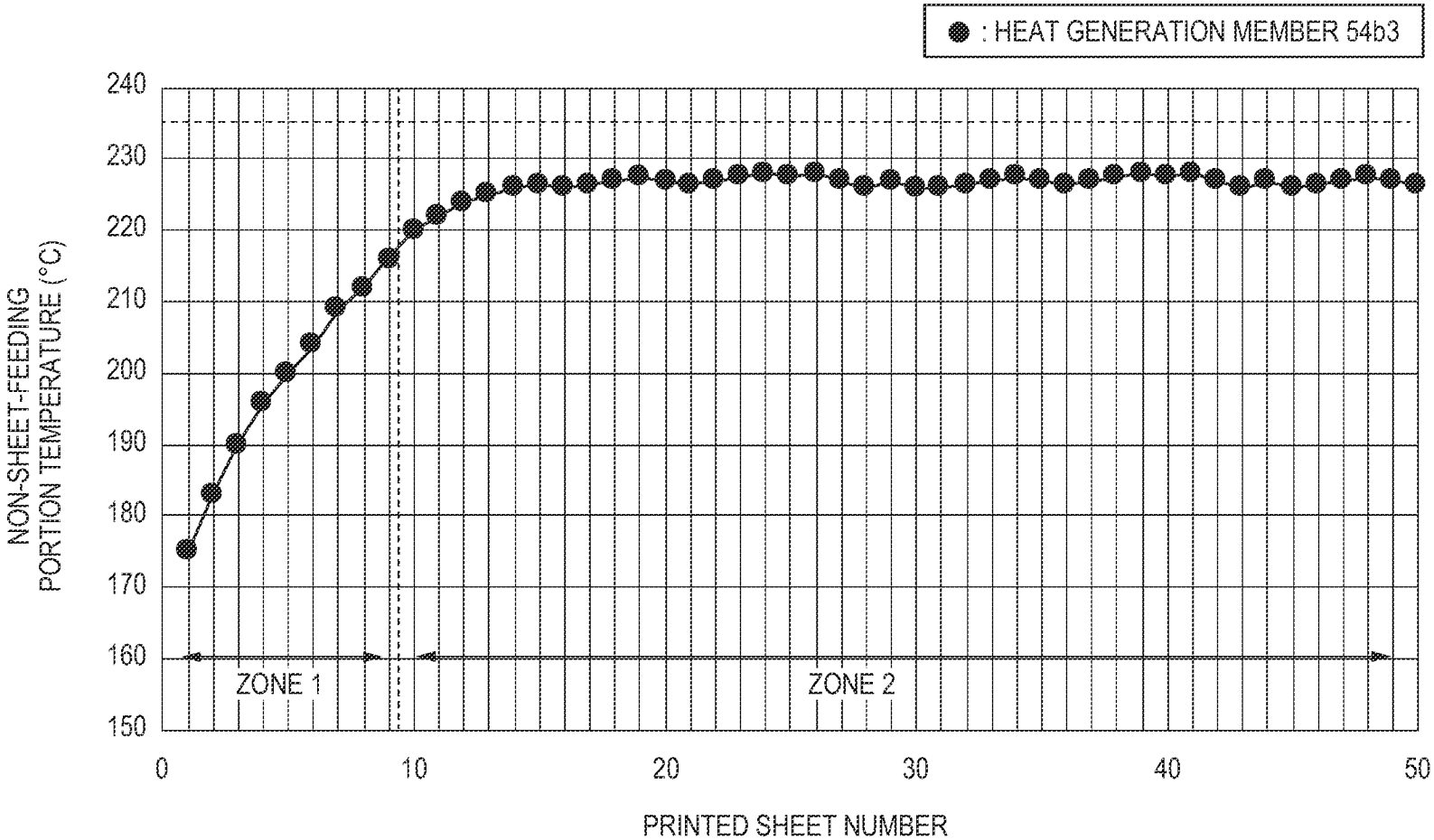
FIG. 10 is a graph illustrating a relationship between a printed sheet number and a non-sheet-feeding portion temperature in Comparison Example of Embodiment 1.

FIG. 10 is a graph made by plotting a maximum temperature of surfaces of the film 51 corresponding to positions of the non-sheet-feeding portion widths H, for each printed sheet number, in a case where the heater 54 in Comparison Example 1 is used to continuously print 50 16K-size sheets. Black dots each indicate that the heat generation members 54*b*3 are used. In FIG. 10, its horizontal axis, vertical axis, and the like are the same as those of FIG. 8. Sheets from a first sheet to a tenth sheet illustrated in the zone 1 were printed with a sheet interval time period of 450 ms and at a production speed (productivity) of 19 sheets per minute, as in Embodiment 1. However, the non-sheet-feeding portion temperature reached 220° C. at the tenth sheet, and thus the non-sheet-feeding portion temperature rise had to be suppressed from an eleventh sheet illustrated in the zone 2 by extending the sheet interval time period to 1500 ms to decrease the production speed to 14 sheets per minute. As a result, in Comparison Example 1, a time taken to continuously print 50 intermediate size sheets was about 198 seconds.

In Embodiment 1, to print the intermediate size sheets, the control to switch between the heat generation member 54*b*1 and the heat generation member 54*b*2 according to the sheet size information on the sheets P and the count value is performed as described above. Specifically, the fixing processing is performed on a first sheet number of sheets P by the heat generation member 54*b*1 in a state where electric power is supplied to the heat generation member 54*b*. When a state where the electric power is supplied to the heat generation member 54*b*1 is switched by the heat generation member switching device 57 to a state where the electric power is supplied to the heat generation member 54*b*2, the fixing processing is performed by the heat generation member 54*b*2 on a second sheet number of sheets P that is less than the first sheet number. This can suppress the non-sheet-feeding portion temperature rise, preventing a decrease in throughput, and thus the time to print 50 sheets can be shortened by 42 seconds as compared with the configuration in Comparison Example 1.

As described above, according to Embodiment 1, the non-sheet-feeding portion temperature rise can be suppressed without decreasing throughput also in a case where the intermediate size sheets are caused to pass the fixing nip portion.

Embodiment 2

Figure 11:
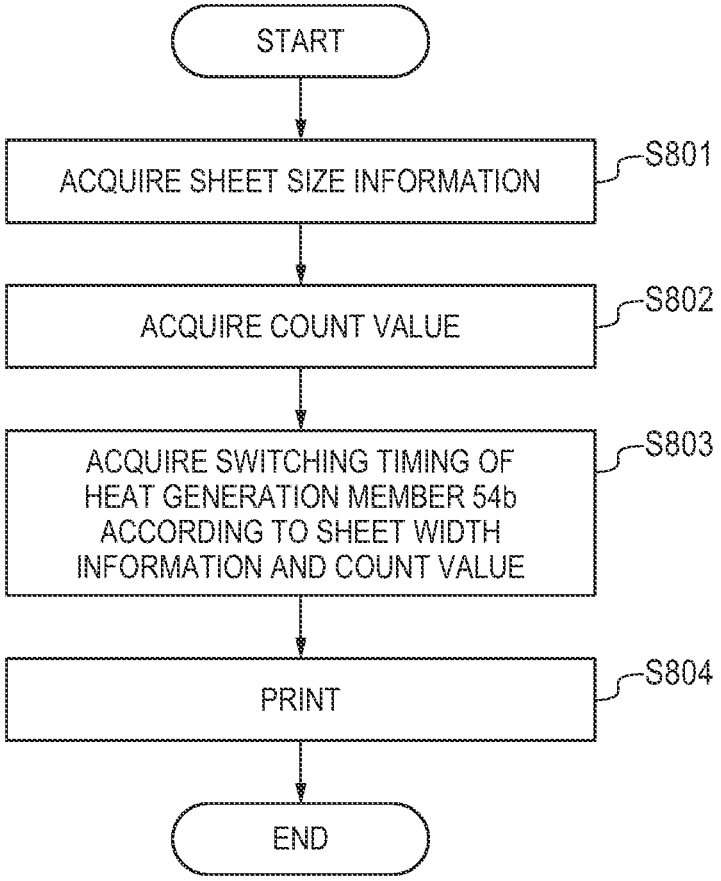
FIG. 11 is a flowchart illustrating print processing in Embodiment 2.

In a configuration of an image forming apparatus applied in Embodiment 2, the same components in Embodiment 1 will be denoted by the same reference characters and will not be described. FIG. 11 illustrates a sequence from receiving a print command to finishing print. Processes of S801, S802 and S804 of FIG. 11 are the same as processes of S701, S702 and S704 of FIG. 5 in Embodiment 1 and will not be described. In Embodiment 2, sheet size information acquired in S801 is information on a width of a sheet P (length in the longitudinal direction). In S803, according to the information on the width of the sheet P being the sheet size information acquired in S801 and the count value acquired in S802, the CPU 94 refers to and acquires a switch control (heat generating pattern) of the heat generation members 54*b*. As previously described, the sheet size information in Embodiment 2 is the information on the width of the sheet P (hereinafter, referred to as sheet width information). In Embodiment 2, by inputting the sheet width information into the PC 110, a switch timing of the heat generation members 54*b* for a sheet width W shown in Table 2 is set.

preventing the deformation of the film 51, the heat generation member 54*b*1 is forcibly used to print, for example, three sheets, for all of the sheet widths W in a case where the print is performed from the cold state. A fourth column of Table 2 shows ratios of sheet numbers for which electric power is supplied, and these ratios are categorized into the zone 1 and the zone 2 as in Table 1 in Embodiment 1. For each zone, the fourth column shows a ratio between sheet numbers for which the heat generation member 54*b*1 and the heat generation member 54*b*2 are used.

A feature of Embodiment 2 is that a switch timing of the heat generation members 54*b* according to the acquired sheet width information is applied even in a case an intermediate size sheet other than the standard size sheets is specified. Note that there may be a method in which a plurality of areas of the sheet size are provided by including the sheet width information as well as information on the length of the sheet P in the conveyance direction, and a switch timing of the heat generation member 54*b* optimum for each area is set.

[Continuous Print Using Switch Control in Table 2]

Figure 12:
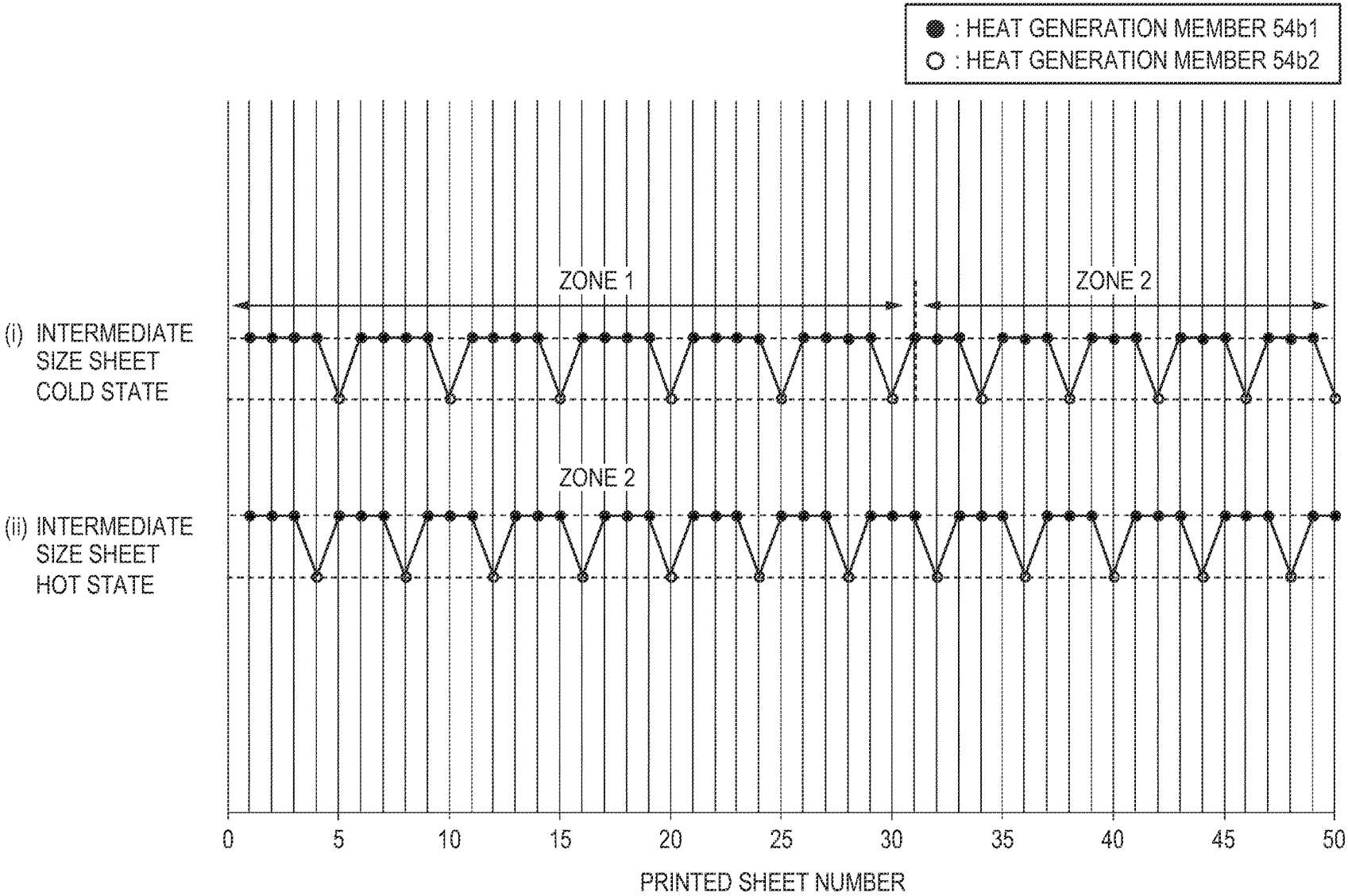
FIG. 12 is a graph illustrating switch timings of a heat generation member 54*b* in Embodiment 2.

Sheets P used in Embodiment 2 are sheets P having a sheet width W being the same as that of a 16K-size sheet, 195 mm, and a length Z being the same as that of a LGL-size sheet, 355.6 mm. A case where these 50 sheets P are continuously printed from the cold state will be described (see FIG. 13 describe below). FIG. 12 is a graph illustrating switch operation for the heat generation members 54*b* in the cold state and the hot state in a case where the CPU 94 refers to Table 2 to perform continuous print on the intermediate size sheets. In FIG. 12, (i) and (ii) illustrate a case where the continuous print is performed on the intermediate size sheets, where (i) illustrates a case where the print is started from the cold state, and (ii) illustrates a case where the print is started from the hot state. In addition, while the sheet interval time period is set at 450 ms in Embodiment 1, the sheet interval time period in Embodiment 2 is set to be longer, 550 ms, and thus the intermediate size sheets in Embodiment 2 are printed at a production speed of 14 sheets per minute.

TABLE 2

| Size classification of sheet | Standard size width W (mm) | Sheet number for which the heat generation member 54b1 is forcibly used to perform print when the print is started from the cold state | Ratio of sheet numbers for which electric power is supplied: Zone 1 Heat generation member 54b1 | Zone 1 Heat generation member 54b2 | Zone 2 Heat generation member 54b1 | Zone 2 Heat generation member 54b2 |
|---|---|---|---|---|---|---|
| Large size sheet | W ≥ 210 | 3 | 1 | — | 1 | — |
| Intermediate size sheet | 210 > W ≥ 208 | 3 | 8 | 1 | 7 | 1 |
| | 208 > W ≥ 206 | 3 | 7 | 1 | 6 | 1 |
| | 206 > W ≥ 204 | 3 | 6 | 1 | 5 | 1 |
| | 204 > W ≥ 200 | 3 | 5 | 1 | 4 | 1 |
| | 200 > W ≥ 194 | 3 | 4 | 1 | 3 | 1 |
| | 194 > W > 185 | 3 | 3 | 2 | 2 | 2 |
| Small size sheet | 185 ≥ W | 3 | — | 1 | — | 1 |

In Table 2, its first column shows size classification of sheets P (large size sheet, etc.), and its second column shows sheet widths W (mm) of the sheets P (e.g., 210>W≥208). A third column of Table 2 shows a sheet number (e.g., three) for which the heat generation member 54*b*1 is forcibly used to perform the print in a case where the print is started from the cold state. As in Embodiment 1, from a viewpoint of The CPU 94 acquires the sheet width W as W=195 mm based on the sheet width information, and from Table 2, performs such control that the heat generation member 54*b*1 is used to perform the fixing processing on four intermediate size sheets in the zone 1, and then the heat generation member 54*b*2 is used to perform the fixing processing on one intermediate size sheet. In addition, from Table 2, the CPU 94 performs such control that the heat generation member 54*b*1 is used to perform the fixing processing on three intermediate size sheets in the zone 2, and then the heat generation member 54*b*2 is used to perform the fixing processing on one intermediate size sheet. Other Respects (black dots and the like, count value, first target count value, etc.) are the same as those in Embodiment 1.

Figure 13:
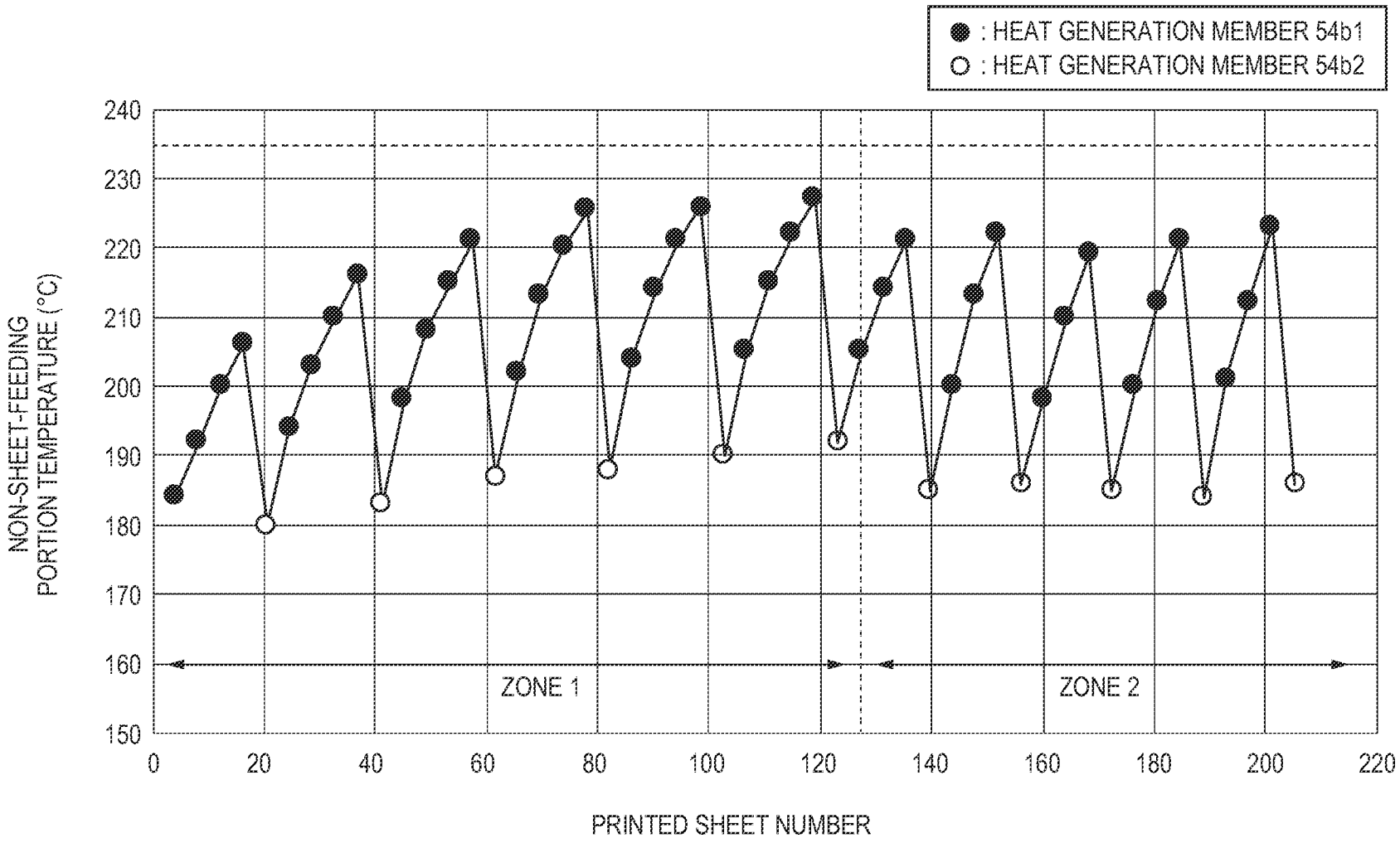
FIG. 13 is a graph illustrating a relationship between a printed sheet number and a non-sheet-feeding portion temperature in Embodiment 2.

FIG. 13 is a graph made by plotting a maximum temperature of surfaces of the film 51 corresponding to positions of the non-sheet-feeding portion widths H of FIG. 7, for each printed sheet number, where its horizontal axis, vertical axis, and the like are the same as those of FIG. 8 in Embodiment 1. The previously-mentioned control (the switch control shown in Table 2) is used to perform the continuous print on 50 intermediate size sheets, and as a result, the maximum temperature of the non-sheet-feeding portions in the film 51 can be suppressed to about 226° C., as illustrated in FIG. 13. In addition, good fixing properties are obtained for all of the non-heat regions K of the 50 intermediate size sheets as in Embodiment 1.

As described above, performing the control in Embodiment 2 can suppress the non-sheet-feeding portion temperature rise while ensuring good fixing properties even for the intermediate size sheets that are long as with the LGL size and are influenced significantly by the non-sheet-feeding portion temperature rise. In addition, even for such intermediate size sheets, the continuous print can be performed on 50 intermediate size sheets while keeping a production speed as high as 14 sheets per minute. As seen from the above, according to Embodiment 2, by using the sheet width information to apply a switch timing of the heat generation members 54*b* according to the sheet width information, a high production speed can be obtained irrespective of the sheet width W.

As described above, according to Embodiment 2, the non-sheet-feeding portion temperature rise can be suppressed without decreasing throughput also in a case where the intermediate size sheets are caused to pass the fixing nip portion.

Embodiment 3

Figure 14:
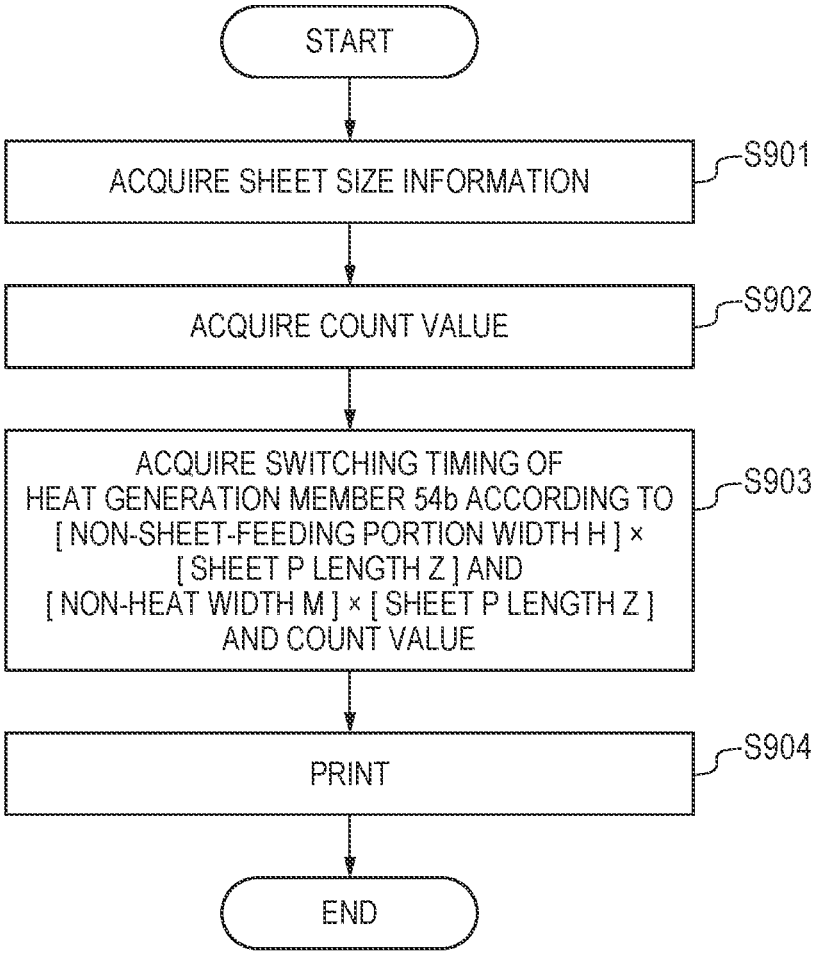
FIG. 14 is a flowchart illustrating print processing in Embodiment 3.

In a configuration of an image forming apparatus applied in Embodiment 3, the same components in Embodiment 1 will be denoted by the same reference characters and will not be described. FIG. 14 illustrates a sequence from receiving a print command to finishing print. Processes of S901, S902 and S904 of FIG. 14 are the same as processes of S701, S702 and S704 of FIG. 5 in Embodiment 1 and will not be described. In S903, according to the sheet size information acquired in S901 and the count value acquired in S902, the CPU 94 refers to and acquires a switch control (heat generating pattern) of the heat generation members 54*b*.

The sheet size information in Embodiment 3 contains a product (H×Z) of the non-sheet-feeding portion width H and the sheet P length Z, and a produce (M×Z) of the non-heat width M and the sheet P length Z, that is, an area of the non-heat region K, illustrated in FIG. 7. More specifically, by receiving the sheet size information into the PC 110, the CPU 94 can compare the length L1 of the heat generation member 54*b*1 and the length L2 of the heat generation member 54*b*2 to calculate the non-sheet-feeding portion width H and the non-heat width M. In addition, by acquiring information on the sheet P length Z from the sheet size information, the CPU 94 can calculate a time at which one sheet P to be printed passes the fixing nip portion N. In Embodiment 3, the sheet P length Z is simply used rather than calculating the time at which the sheet P passes the fixing nip portion N, from the sheet P length Z.

With these pieces of information acquired, the CPU 94 can predict a degree E1 of the non-sheet-feeding portion temperature rise occurring in the fixing nip portion N every time one sheet P is printed, and a degree E2 that is a degree of heat necessary for fixing the non-heat regions K and a degree of cooling the non-heat widths H. In Embodiment 3, the degree E1 is predicted as E1=Non-sheet-feeding portion width H×Sheet P length Z, and the degree E2 is predicted as E2=Non-heat width M×Sheet P length Z. The degree E1 being a first degree is a degree of a temperature rise occurring in portions where the heat generation member 54*b*1 is out of contact with a sheet P (non-sheet-feeding portions) in a case where the heat generation member 54*b*1 is used to perform the fixing processing based on a width of the sheet P. The degree E2 being a second degree is a degree of heat necessary for portions where the heat generation member 54*b*2 does not heat a sheet P (non-heat regions K) in a case where the heat generation member 54*b*2 is used to perform the fixing processing based on a width of the sheet P, and a degree of cooling the non-sheet-feeding portions. As seen from the above, with the configuration in Embodiment 3, the calculation of the degree E1 and the degree E2 enables the setting of a switch timing for the heat generation members 54*b* so as to obtain an optimum performance for any size of intermediate size sheets other than the standard size sheets.

[Continuous Print Using Switch Control in Table 3]

Hereinafter, control in Embodiment 3 will be described specifically with a case where intermediate size sheets in Embodiment 3 are continuously printed, by way of example. Sheets P used in Embodiment 3 are sheets P having a sheet width W being the same as that of a 16K-size sheet, 195 mm, and a length Z being half that of a LGL-size sheet, 178 mm. Fifty of these sheets P are continuously printed from the cold state. Before starting the print, the CPU 94 calculates the non-sheet-feeding portion width H=13.5 mm and the non-heat width M=5 mm, from the sheet size information input into the PC 110. In addition, using these values, the CPU 94 calculates the degree E1=Non-sheet-feeding portion width H×Sheet P length Z=2403 $mm^2$ and the degree E2=Non-heat width M×Sheet P length Z=890 $mm^2$.

TABLE 3

| | Zone 1 | Zone 2 |
|---|---|---|
| E1 integrated value | 20000 | 18000 |
| E2 integrated value | 2000 | 2000 |

(Unit: $mm^2$)

Table 3 is a table that is set from a viewpoint of suppressing the non-sheet-feeding portion temperature rise and a viewpoint of obtaining good fixing properties in the non-heat regions K, in the zone 1 and the zone 2. That is, Table 3 is a table showing E1 target integrated values with which the heat generation member 54*b*1 has to be switched to the heat generation member 54*b*2 and E2 target integrated values with which the heat generation member 54*b*2 has to be switched to the heat generation member 54*b*1. Here, the E1 target integrated values refer to integrated values of the degree E1 with which the heat generation member 54*b*1 has to be switched to the heat generation member 54*b*2 (hereinafter, referred to as E1 integrated values). The E2 target integrated values refer to integrated values of the degree E2 with which the heat generation member 54*b*2 has to be switched to the heat generation member 54b1. In Table 3, its first column shows the integrated values, its second column shows target integrated values of the integrated values in the zone 1, and its third column shows the target integrated values in the zone 2. For example, in the zone 1, the E1 target integrated value of the E1 integrated value is 20000 $mm^2$, and the E2 target integrated value of the E2 integrated value is 2000 $mm^2$. With respect to these target integrated values, the CPU 94 calculates that the target integrated value is reached at an n-th sheet of the continuous print and the target integrated value is exceeded at an n+1-th sheet to set a switch timing of the heat generation members 54b.

Specifically, with the degree E1=2403 $mm^2$ as previously described and n=8 sheets, the calculation is as E1 integrated value=19224 $mm^2$ (=2403 $mm^2$×8 sheets) in a case where the heat generation member 54b1 is used to perform the fixing processing in the zone 1 in Embodiment 3. In addition, with n+1=9 sheets, the calculation is as E1 integrated value=21627 $mm^2$ (=2403 $mm^2$×9 sheets). From the above, the CPU 94 sets the switch timing of the heat generation members 54b such that the heat generation member 54b1 is switched to the heat generation member 54b2 when the printed sheet number reaches n=8 sheets that produces not more than 20000, which is the E1 target integrated value of the E1 integrated value in the zone 1 in Table 3.

Similarly, with the degree E2=890 $mm^2$ as previously described and n=2 sheets, the calculation is as E2 integrated value=1780 $mm^2$ (=890 $mm^2$×2 sheets) in a case where the heat generation member 54b2 is used to perform the fixing processing in the zone 1 in Embodiment 3. In addition, with n+1=3 sheets, the calculation is as E2 integrated value=2670 $mm^2$ (=890 $mm^2$×3 sheets). From the above, the CPU 94 sets the switch timing of the heat generation members 54b such that the heat generation member 54b2 is switched to the heat generation member 54b1 when the printed sheet number reaches n=2 sheets that produces not more than 2000, which is the E2 target integrated value of the E2 integrated value in the zone 1 in Table 3.

Moreover, in the zone 2, with the degree E1=2403 $mm^2$ as previously described and n=7 sheets, the calculation is as E1 integrated value=16821 $mm^2$ (=2403 $mm^2$×7 sheets) in a case where the heat generation member 54b1 is used to perform the fixing processing. In addition, with n+1=8 sheets, the calculation is as E1 integrated value= 19224 $mm^2$ (=2403 $mm^2$×8 sheets). From the above, the CPU 94 sets the switch timing of the heat generation members 54b such that the heat generation member 54b1 is switched to the heat generation member 54b2 when the printed sheet number reaches n=7 sheets that produces not more than 18000, which is the E1 target integrated value of the E1 integrated value in Table 3. In addition, in a case where the heat generation member 54b2 is used to perform the continuous print in the zone 2, the E2 target integrated value is 2000, which is the same as the E2 target integrated value in the zone 1. From this, the CPU 94 sets the switch timing of the heat generation members 54b such that the heat generation member 54b2 is switched to the heat generation member 54b1 at n=2 sheets, as in the zone 1.

Figure 15:
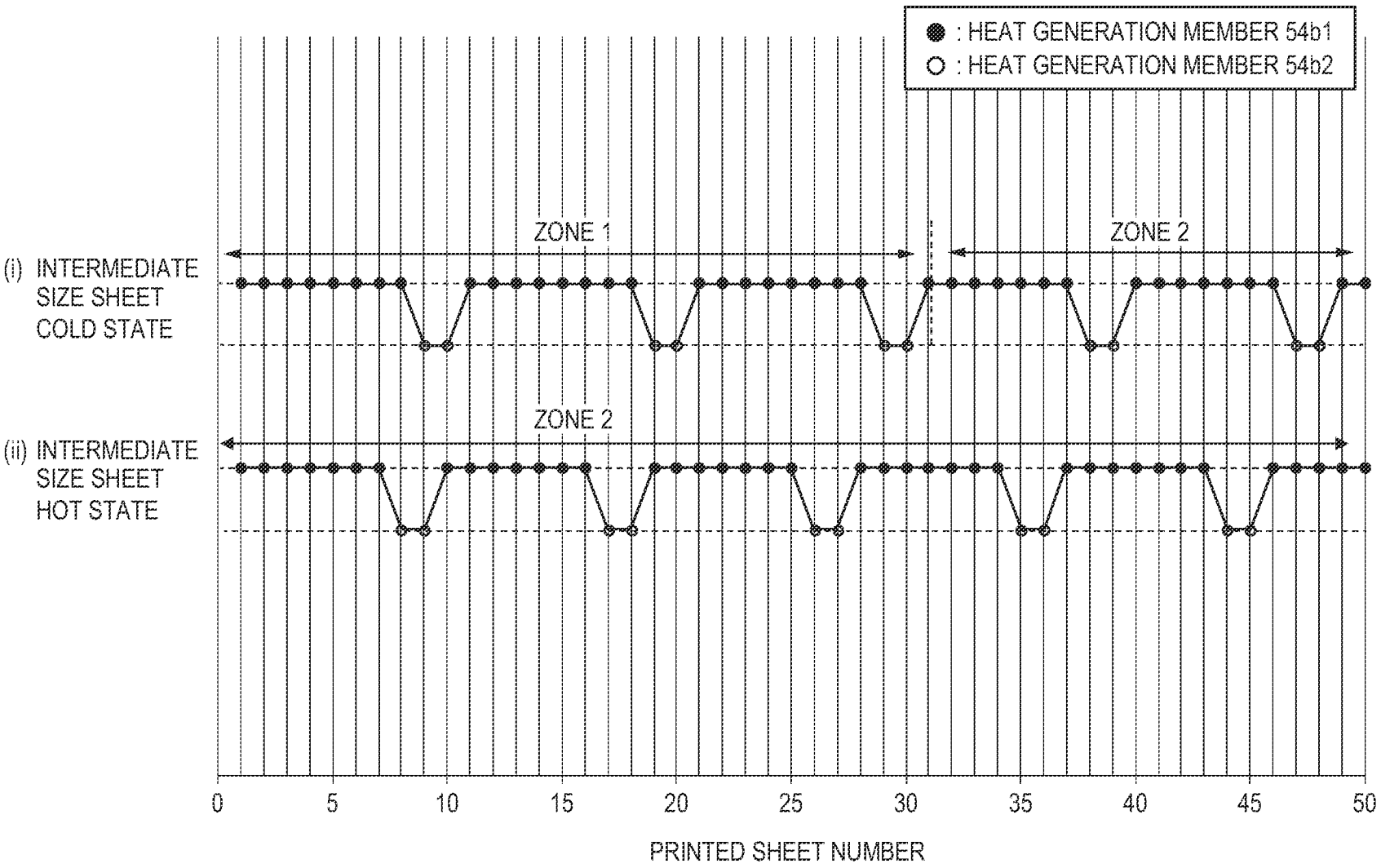
FIG. 15 is a graph illustrating switch timings of a heat generation member 54*b* in Embodiment 3.

As seen from the above, before starting the print, the CPU 94 calculates the degree E1 and the degree E2 and compares them with the target integrated values in Table 3 to calculate the sheet number n at which the heat generation members 54b have to be switched. As a result, switch timings of the heat generation members 54b as illustrated in FIG. 15 are determined. In FIG. 15, (i) and (ii) illustrate a case where the continuous print is performed on the intermediate size sheets, where (i) illustrates a case where the print is started from the cold state, and (ii) illustrates a case where the print is started from the hot state. In the case where the print is started from the hot state, the zone 2 for the cold state is applied. As illustrated in (i) of FIG. 15, in a case where the fixing processing is performed on intermediate size sheets from the cold state, in the zone 1, the heat generation member 54b1 is used to perform the fixing processing on eight intermediate size sheets, and then the heat generation member 54b2 is used to perform the fixing processing on two intermediate size sheets. When the count value becomes not less than 30, the CPU 94 transitions from the zone 1 to the zone 2. In other words, when the count value becomes not less than 30 while the fixing processing is performed on the sheets P continuously, the CPU 94 changes the switch timing for the heat generation member 54b1 and the heat generation member 54b2.

In the zone 2, the heat generation member 54b1 is used to perform the fixing processing on seven intermediate size sheets, and then the heat generation member 54b2 is used to perform the fixing processing on two intermediate size sheets. As illustrated in (ii) of FIG. 15, in a case where the fixing processing is performed on intermediate size sheets from the hot state, the print is started with the zone 2. Therefore, the heat generation member 54b1 is used to perform the fixing processing on seven intermediate size sheets, and then the heat generation member 54b2 is used to perform the fixing processing on two intermediate size sheets.

In addition, in Embodiment 3, the sheet interval time period is calculated based on the degree E1, such that, for example, sheet interval time period=0.0834×E1+149.4 (in ms). In the case of the intermediate size sheets in Embodiment 3, the sheet interval time period is calculated as 350 ms since the degree E1=2403 $mm^2$. This calculation formula calculates an optimum sheet interval time period from the degree E1 of the non-sheet-feeding portion temperature rise. As a result, by performing the control in Embodiment 3, the continuous print of the intermediate size sheets is performed at a production speed of 28 sheets per minute.

Here, a case where the control in Embodiment 2 is used to print intermediate size sheets having a length half that of the LGL size in Embodiment 3 will be described. Since the control in Embodiment 2 is based on the sheet width information, the same switch frequency of the heat generation members 54b and the same sheet interval time period (550 ms) as those in Embodiment 2 are set also for the intermediate size sheets in Embodiment 3, and based on the sheet interval time period, the print is performed at a production speed of 25 sheets per minute. In Table 2 in Embodiment 2, the zone 1 (four for the heat generation member 54b1, one for the heat generation member 54b2) and the zone 2 (three for the heat generation member 54b1, one for the heat generation member 54b2) of "200>W≥194" for the intermediate size sheet having the sheet width W (=195 mm) are used.

Figure 16A:
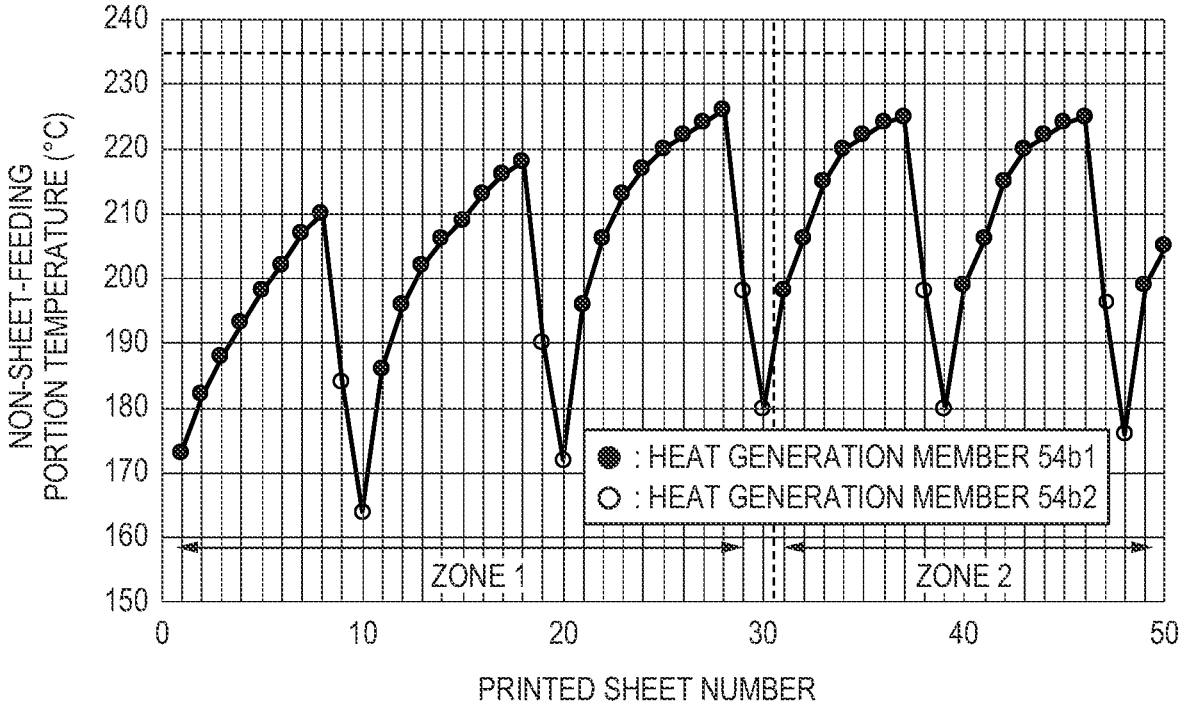
FIG. 16A and FIG. 16B are graphs each illustrating a relationship between a printed sheet number and a non-sheet-feeding portion temperature in Embodiment 3.
Figure 16B:
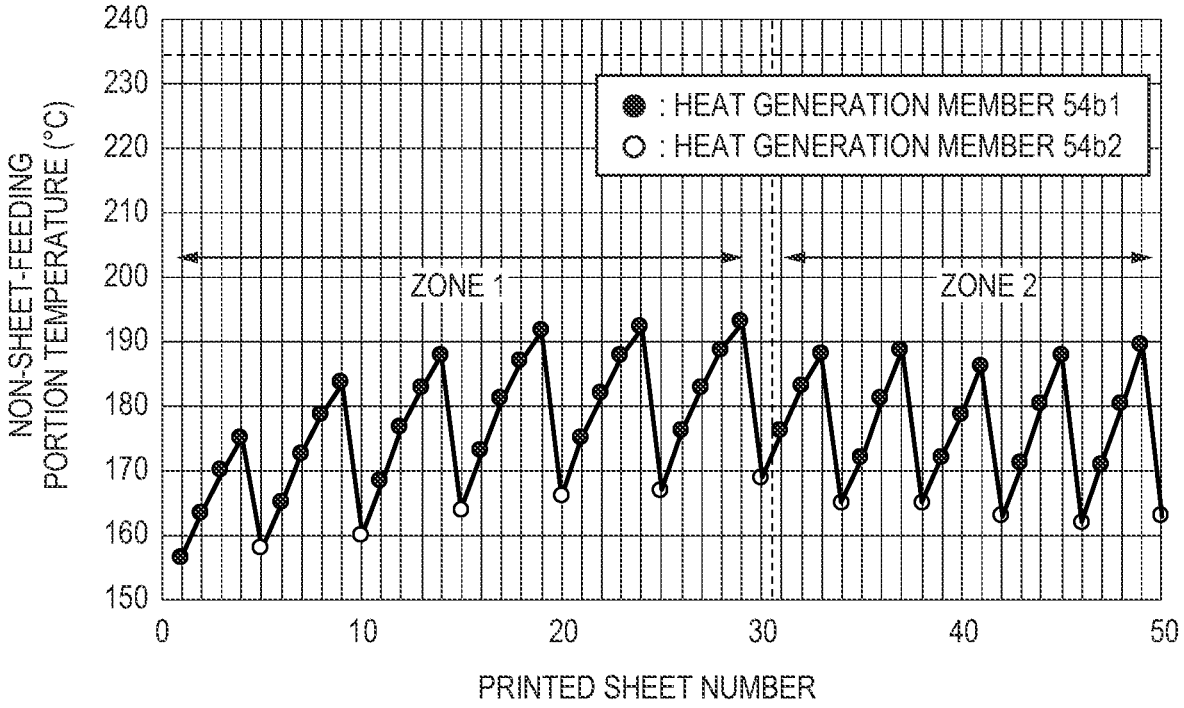

FIG. 16B is a graph made by plotting a maximum temperature of surfaces of the film 51 corresponding to positions of the non-sheet-feeding portion widths H of FIG. 7, for each printed sheet number, in a case where the control in Embodiment 2 is used for the intermediate size sheets in Embodiment 3. As illustrated in FIG. 16B, while 50 intermediate size sheets are printed continuously, the maximum temperature of the non-sheet-feeding portions can be suppressed to 193° C., a very low temperature. A reason for this is that a high switch frequency of the heat generation members 54b and a long sheet interval time period (550 ms) are used, and furthermore, occasions of cooling the fixing nip portion N increase because a length of the intermediate size sheets are half as short as that of the LGL size, which increases a sheet interval time period per minute.

However, from a viewpoint of a durability of the heat generation member switching device 57, an increase in number of switches is not desirable, and it is desirable to keep the number of switches at a minimum. In addition, from a viewpoint of improving a production speed of print per minute, it is desirable to set a bare minimum of the sheet interval time period. Considering the above viewpoints, it is possible that the configuration in Embodiment 3 is more desirable.

FIG. 16A is a graph made by plotting a maximum temperature of surfaces of the film 51 corresponding to positions of the non-sheet-feeding portion widths H of FIG. 7, for each printed sheet number, in a case where the control in Embodiment 3 is used to print 50 intermediate size sheets continuously. The maximum temperature of the non-sheet-feeding portions in the film 51 can be suppressed to 226° C., at which breakage of the film 51 does not occur. In addition, good fixing properties are obtained for all of the non-heat regions K of the 50 intermediate size sheets as in Embodiment 1.

As described above, the configuration in Embodiment 3 enables the setting of an optimum switch frequency of the heat generation members 54*b* and an optimum sheet interval time period for the sheet width W and the length Z of the intermediate size sheet, which can suppress the non-sheet-feeding portion temperature rise while ensuring good fixing properties in the non-heat regions K. As previously described, in a case of the control performed based on the sheet width information in Embodiment 2, the intermediate size sheets in Embodiment 3 can be printed at a production speed of 25 sheets per minute. In contrast, in a case of the control in Embodiment 3, the intermediate size sheets in Embodiment 3 can be printed at a production speed of 28 sheets per minute, which enables a further improvement in production speed. In addition, the switch frequency of the heat generation member 54*b*1 and the heat generation member 54*b*2 during printing the 50 intermediate size sheets can be reduced to 10 in Embodiment 3 in contrast to 21 by the control in Embodiment 2.

As described above, according to Embodiment 3, the non-sheet-feeding portion temperature rise can be suppressed without decreasing throughput also in a case where the intermediate size sheets are caused to pass the fixing nip portion.

Embodiment 4

Figure 17:
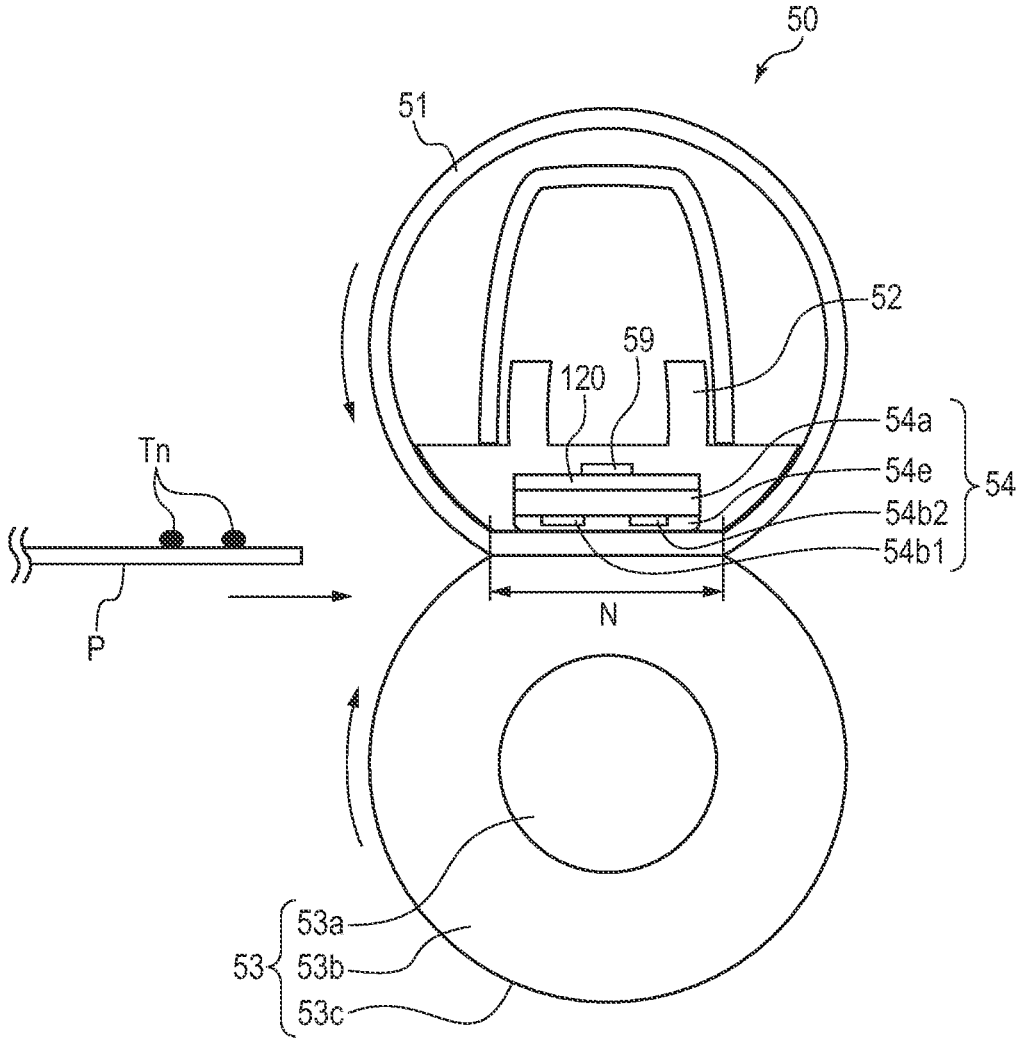
FIG. 17 is a cross-sectional schematic diagram of a vicinity of a center portion of a fixing apparatus in the longitudinal direction in Embodiment 4.

In a configuration of an image forming apparatus applied in Embodiment 4, the same components in Embodiment 1 will be denoted by the same reference characters and will not be described. FIG. 17 is a cross-sectional schematic diagram of a fixing apparatus 50 in Embodiment 4. In Embodiment 4, unlike Embodiment 1, heatsinks 120 are provided between a back surface of the heater 54 and the nip forming member 52. The heatsinks 120 are members that connect end portions of the heat generation member 54*b*1 in the longitudinal direction and end portions of the heat generation member 54*b*2 in the longitudinal direction. The rest of the configuration is the same as that illustrated in FIG. 3 in Embodiment 1 and will not be described.

Figure 18A:
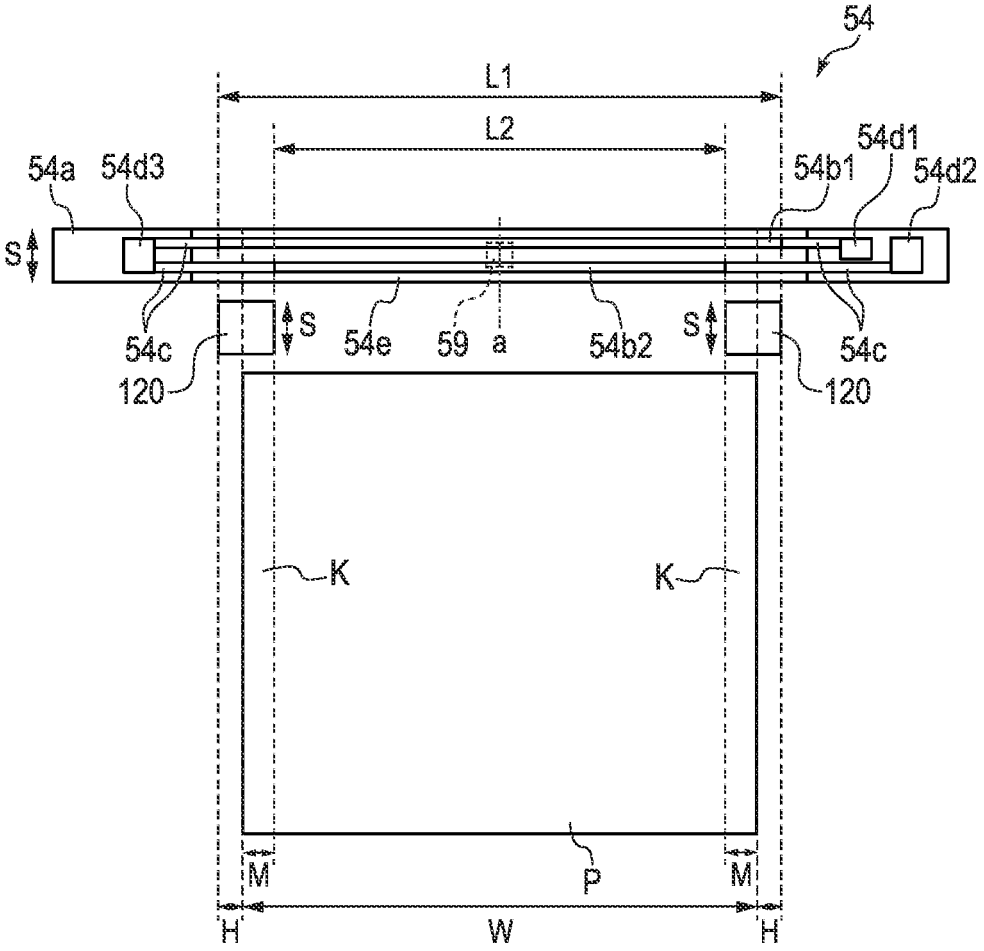
FIG. 18A is a diagram illustrating a positional relationship between a heater, heatsinks, and a sheet in the longitudinal direction in Embodiment 4.

FIG. 18A is a diagram illustrating positions of the heatsinks 120 in the longitudinal direction of the heater 54, where the heatsinks 120 are illustrated being shifted from the heater 54 in the conveyance direction for convenience of description. The same configurations as those illustrated in FIG. 7 will be denoted by the same reference characters and will not be described. The heatsinks 120 are each provided to position between an end portion of the heat generation member 54*b*1 and an end portion of the heat generation member 54*b*2. As a material of the heatsinks 120, for example, an aluminum plate having a heat conductivity of 230 W/(m·K) (JIS alloy name: A1050) is used. Sizes of the heatsinks 120 are a length of 18.5 mm in the longitudinal direction, a length S in the conveyance direction of S=7 mm (the same as the width of the heater 54), and a thickness of 0.3 mm. The heatsinks 120 are each bent partially to form a positioning portion (not illustrated), and with the positioning portion, each heatsink 120 is attached to the nip forming member 52. With the configuration in Embodiment 4, the heatsinks 120 enables heat of the non-sheet-feeding portion temperature rise in the non-sheet-feeding portion widths H to be transferred to the non-heat regions K efficiently, which provides two advantageous effects including an effect of settling down the non-sheet-feeding portion temperature rise and an effect of improving the fixing properties in the non-heat regions K.

In Embodiment 4, a case where 50 intermediate size sheets of 16K size are printed continuously as in Embodiment 1 will be described. In addition, based on information on printing the sheets of the 16K size as in Embodiment 1, a standard size, the same switch timing of the heat generation members 54*b* as that in Embodiment 1 is used to print the 50 sheets from the cold state. Note that, considering the effect of settling down the non-sheet-feeding portion temperature rise brought by the heatsinks 120, the sheet interval time period is set at 330 ms in Embodiment 4 while the sheet interval time period in Embodiment 1 is 450 ms. As a result, the production speed per minute is improved to 20 sheets in Embodiment 4 in contrast to 19 sheets in Embodiment 1.

Figure 18B:
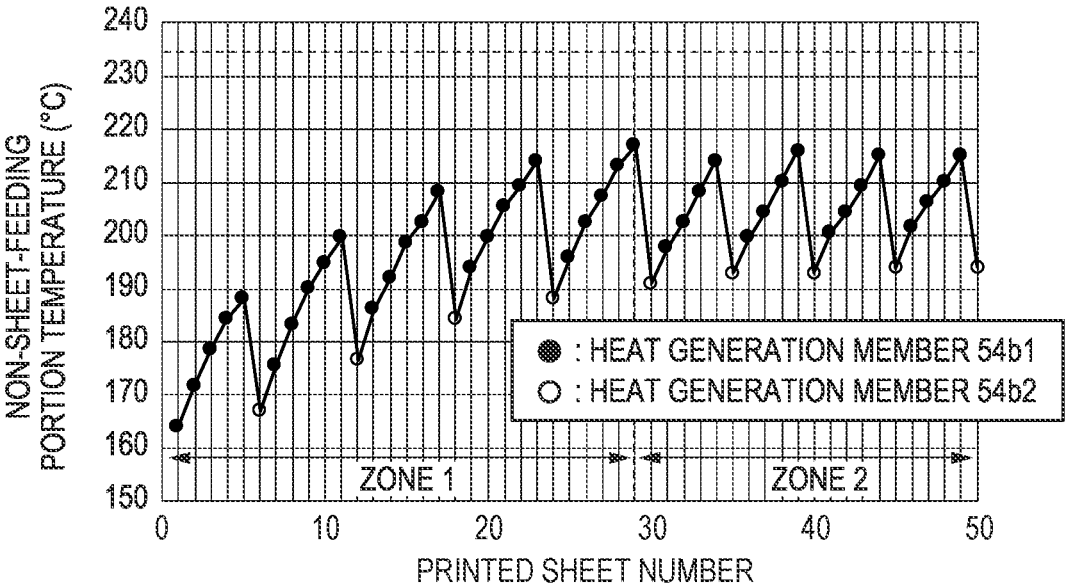
FIG. 18B is a graph illustrating a printed sheet number and a non-sheet-feeding portion temperature in Embodiment 4.

FIG. 18B is a graph made by plotting a maximum temperature of surfaces of the film 51 corresponding to positions of the non-sheet-feeding portion widths H of FIG. 18A, for each printed sheet number. With the configuration including the heatsinks 120, the previously-mentioned control (the control shown in Table 1) is used to perform the continuous print on intermediate size sheets up to a 50th sheet, and as a result, the maximum temperature of the non-sheet-feeding portions in the film 51 can be suppressed to 217° C. In addition, good fixing properties equal to or better than those in Embodiment 1 are obtained for all of the non-heat regions K of the 50 sheets.

Note that the method for switch control of the heat generation members 54*b* described in Embodiment 4 is merely an example, and any control that is set optimally for the standard sizes of various kinds of intermediate size sheets, the sheet width W, or both of the sheet width W and the sheet length Z may be used. That is, the controls described in Embodiment 1 to Embodiment 3 may be applied to the configuration including the heatsinks 120. In addition, the length and the number of the heat generation members 54*b*, the thickness and the length of the heatsinks 120, and the like are merely an example and are not limited to the described numeric values. In addition, the material of the heatsinks 120 may be a metal other than aluminum described in Embodiment 4 or a high heat conducting sheet such as a graphite sheet.

As described above, according to Embodiment 4, the non-sheet-feeding portion temperature rise can be suppressed without decreasing throughput also in a case where the intermediate size sheets are caused to pass the fixing nip portion.

[Modification]

Figure 19A:
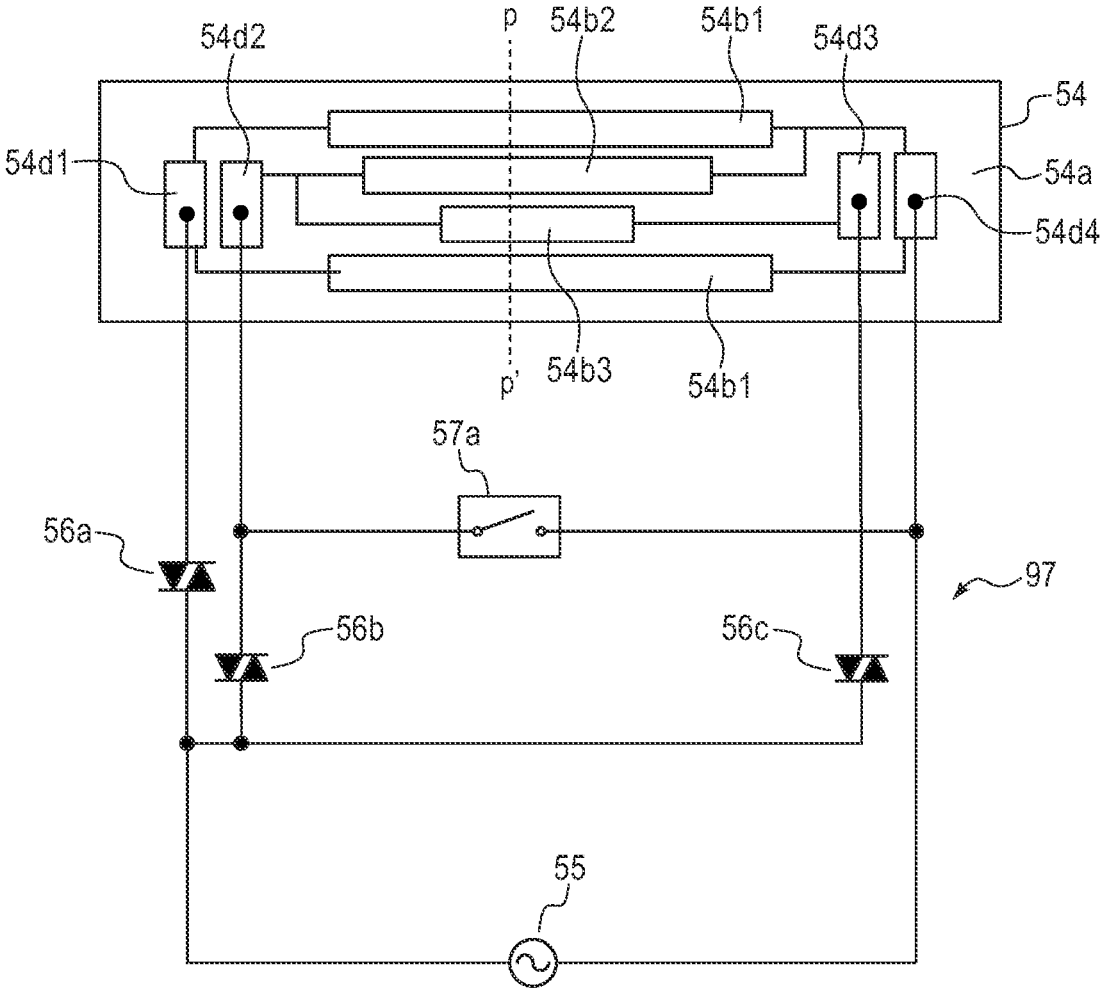
FIG. 19A and FIG. 19B are diagrams illustrating a heater and a heater control circuit described in a modification.
Figure 19B:
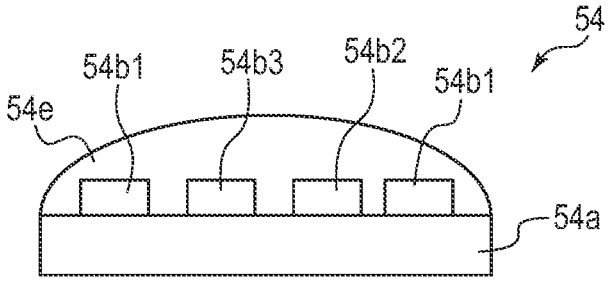

Moreover, the length and the number of the heat generation members 54*b* are not limited to the numeric values described in the embodiments previously described. For example, as illustrated in FIG. 19A and FIG. 19B, the heater 54 may be a heater 54 that includes two heat generation members 54*b*1, one heat generation member 54*b*2, and one heat generation member 54*b*3 having three respective different length. In a modification, the heat generation member 54*b*2 and the heat generation member 54*b*3 function as the second heat generation member. In detail, the heat generation member 54*b*2 functions as a third heat generation member and the heat generation member 54*b*3 functions as a fourth heat generation member. The heat generation members 54*b*1 includes one heat generation member 54*b*1 disposed at one end portion of the substrate 54*a* in the transverse direction and the other heat generation member 54*b*1 disposed at the other end portion. In the transverse direction of the substrate 54*a*, the one heat generation member 54*b*1, the heat generation member 54*b*2, the heat generation member 54*b*3, and the other heat generation member 54*b*1 are disposed in this order.

The heater used in a heating apparatus in the modification and a power control unit 97 being a heater control circuit are illustrated in FIG. 19A and FIG. 19B. FIG. 19A illustrates the heater 54 and the power control unit 97, and the FIG. 19B illustrates a p-p' cross section of the heater 54. The heater 54 is mainly constituted by the heat generation members 54*b*1 to 54*b*3 mounted on the substrate 54*a* formed of ceramic or the like (on the substrate), contacts 54*d*1 to 54*d*4, and a protection glass layer 54*e* made of an insulation glass or the like. The heat generation members 54*b*1 to 54*b*3 are resistive bodies that generate heat with supply of electric power from an AC power supply 55 such as a commercial AC power supply. The contact 54*d*1 being a first contact and the contact 54*d*2 being a second contact are provided at the one end portion of the substrate 54*a* in the longitudinal direction. The contact 54*d*3 being a third contact and the contact 54*d*4 being a fourth contact are provided at the other end portion of the substrate 54*a* in the longitudinal direction. In this manner, a number of contacts (electrodes) provided on each of the end portions of the substrate 54*a* is set to be the same number, for example, two. The protection glass layer 54*e* is provided to insulate a user from the heat generation members 54*b*1 to 54*b*3 at substantially the same electric potential as that of the AC power supply 55.

For example, lengths of the heat generation members 54*b*1, the heat generation member 54*b*2, and the heat generation member 54*b*3 set at to be longer by about several millimeters than a width 215.9 mm of letter size, a width 182 mm of B5 size, and a width 148 mm of A5 size, respectively. By providing a plurality of kinds of the heat generation members 54*b* in this manner, the intermediate size sheets having more kinds of the sizes can be supported. That is, in a case where an intermediate size sheet having a size between the letter size and the B5 size is fed, the heat generation members 54*b*1 and the heat generation member 54*b*2 may be switched alternately. In a case where an intermediate size sheet having a size between the B5 size and the A5 size is fed, the heat generation members 54*b*1 and the heat generation member 54*b*3 may be switched alternately.

The contact 54*d*1 is connected to a first electrode of the AC power supply 55 via a triac 56*a* being a first switch unit. The contact 54*d*2 is connected to the first electrode of the AC power supply 55 via a triac 56*b* being a second switch unit. The contact 54*d*3 is connected to the first electrode of the AC power supply 55 via a triac 56*c* being a third switch unit. The contact 54*d*4 is connected to a second electrode of the AC power supply 55 via no triac or the like. The contact 54*d*2 and the contact 54*d*4 are connected to an electromagnetic relay 57*a* of the contact configuration of "a" being a first switching unit. The electromagnetic relay 57*a* brings an electric path between the contact 54*d*2 and the contact 54*d*4 (electric power supply path) into a connected state (hereinafter, referred to as short-circuit state) or an open state.

Figure 20A:
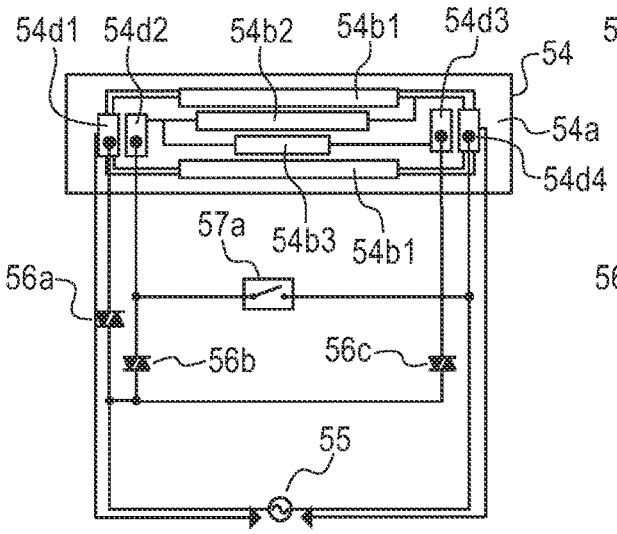
FIG. 20A, FIG. 20B and FIG. 20C are diagrams each illustrating a current path in the heater and the heater control circuit described in a modification.
Figure 20B:
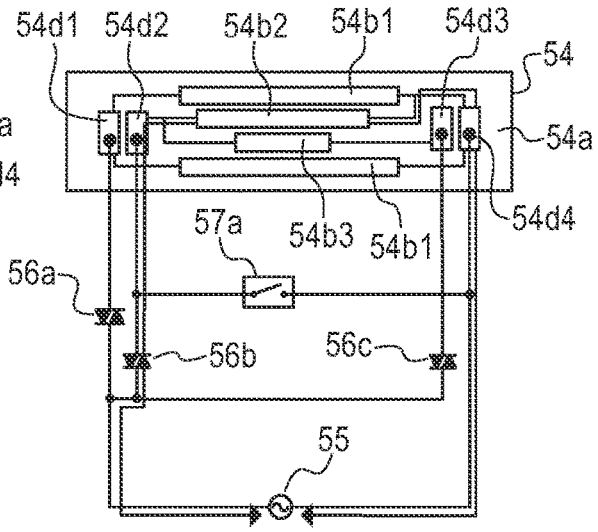
Figure 20C:
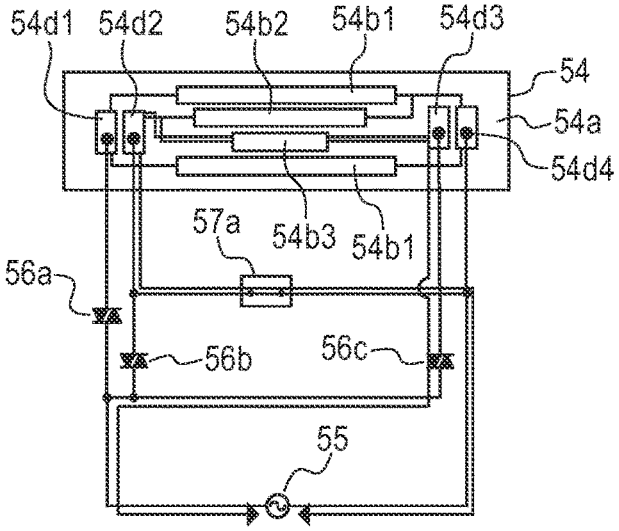

Next, a method for a case where electric power is supplied while the heat generation members 54*b*1 and the heat generation member 54*b*2, and the heat generation members 54*b*1 and the heat generation member 54*b*3 are switched respectively from one to another, will be described. FIG. 20A, FIG. 20B and FIG. 20C illustrate three current paths (being electric paths and power supply paths) to the heat generation members 54*b*1 to 54*b*3 in a case where the heater 54 including the heat generation members 54*b*1, 54*b*2 and 54*b*3 having the three lengths and the power control unit 97 are used. Note that the current paths illustrated in FIG. 20A, FIG. 20B and FIG. 20C are merely an example, and other current path configurations may be possible.

(Supply of Electric Power to Heat Generation Members 54*b*1)

Current in a case where electric power is supplied from the AC power supply 55 to the heat generation members 54*b*1 flows along a route illustrated by bold lines in FIG. 20A. A temperature detection element such as a thermistor (not illustrated) senses a temperature of the heater 54, the triac 56*a* operates based on instructions from a microcomputer (not illustrated) based on information on the temperature, and the heat generation members 54*b*1 are thereby controlled so as to be at a predetermined temperature. The supply of electric power to the heat generation members 54*b*1 does not depends on the triacs 56*b* and 56*c* and the electromagnetic relay 57*a* having the contact configuration of "a". That is, in a case where electric power is supplied to the heat generation members 54*b*1, the electromagnetic relay 57*a* may be in either the open state or the short-circuit state. In FIG. 20A, the electromagnetic relay 57*a* is in the open state, as an example.

(Supply of Electric Power to Heat Generation Member 54*b*2)

Current in a case where electric power is supplied from the AC power supply 55 to the heat generation member 54*b*2 flows along a route illustrated by bold lines in FIG. 20B. In the case where electric power is supplied to the heat generation member 54*b*2, a contact of the electromagnetic relay 57*a* having the contact configuration of "a" is set to be in an open state. In its open state, the electromagnetic relay 57*a* having the contact configuration of "a" has a contact impedance that is sufficiently higher than that of the heat generation member 54*b*2, and thus almost no current flows through the electromagnetic relay 57*a* having the contact configuration of "a", which can cause only the heat generation member 54*b*2 to generate heat. The electric power supplied to the heat generation member 54*b*2 is controlled by the triac 56*b*.

(Supply of Electric Power to Heat Generation Member 54*b*3)

Current in a case where electric power is supplied from the AC power supply 55 to the heat generation member 54*b*3 flows along a route illustrated by bold lines in FIG. 20C. In the case where electric power is supplied to the heat generation member 54*b*3, almost all of the current flows through the heat generation member 54*b*3 by setting the contact of the electromagnetic relay 57*a* having the contact configuration of "a" to be in the short-circuit state. In its short-circuit state, the electromagnetic relay 57*a* having the contact configuration of "a" has a contact impedance that is sufficiently lower than that of the heat generation member 54*b*2, and thus almost no current flows through the heat generation member 54*b*2, which can cause only the heat generation member 54*b*3 to generate heat. The electric power supplied to the heat generation member 54*b*3 is controlled by the triac 56*c*.

[Switch Between Power Supply Paths]

In switching between the electric power supply path to the heat generation members 54*b*1 (FIG. 20A) and the electric power supply path to the heat generation member 54*b*2 (FIG. 20B), the contact of the electromagnetic relay 57*a* having the contact configuration of "a" is brought into the open state in advance. This enables the control to be performed only with contactless switches of the triac 56*a* and the triac 56*b*, independently. Therefore, a state transition between the electric power supply path (FIG. 20A) and the electric power supply path (FIG. 20B) can be performed seamlessly, or both of the electric power supply path (FIG. 20A) and the electric power supply path (FIG. 20B) can be used.

This holds true for switching between the electric power supply path to the heat generation member 54*b*1 (FIG. 20A) and the electric power supply path to the heat generation member 54*b*3 (FIG. 20C). As previously described, in a case of the electric power supply path (FIG. 20A), the electromagnetic relay 57*a* may be in either the open state or the short-circuit state. Therefore, bringing the contact of the electromagnetic relay 57*a* having the contact configuration of "a" into the short-circuit state enables the following thing. That is, a state transition between the electric power supply path (FIG. 20A) and the electric power supply path (FIG. 20C) can be performed seamlessly, or both of the electric power supply path (FIG. 20A) and the electric power supply path (FIG. 20C) can be used.

In contrast, in switching between the electric power supply path to the heat generation member 54*b*2 (FIG. 20B) and the electric power supply path to the heat generation member 54*b*3 (FIG. 20C), a state of the electromagnetic relay 57*a* having the contact configuration of "a" has to be switched. Therefore, both of the electric power supply path to the heat generation member 54*b*2 (FIG. 20B) and the electric power supply path to the heat generation member 54*b*3 (FIG. 20C) cannot be used at the same time. That is, only one of the electric power supply path (FIG. 20B) and the electric power supply path (FIG. 20C) can be used, and these are mutually exclusive.

However, in a case where transition between the electric power supply path (FIG. 20B) and the electric power supply path (FIG. 20C) is intended, the following works. For example, a state transition may be performed such that electric power supply path (FIG. 20B)→electric power supply path (FIG. 20A)→electric power supply path (FIG. 20C), or electric power supply path (FIG. 20C)→electric power supply path (FIG. 20A)→electric power supply path (FIG. 20B). In either state transition, the electric power supply path (FIG. 20A) is interposed between the electric power supply path (FIG. 20B) and the electric power supply path (FIG. 20C). While the electric power supply path (FIG. 20A) is used, the state of the electromagnetic relay 57*a* having the contact configuration of "a" is switched from the open state to the short-circuit state or from the short-circuit state to the open state. This can prevent a situation where a heat quantity necessary for a sheet P cannot be supplied because the supply of electric power to the heater 54 is stopped to wait for the state of the contact of the electromagnetic relay 57*a* having the contact configuration of "a" to be stabilized.

The electromagnetic relay 57*a* is not limited to an electromagnetic relay having a contact configuration of "a", and a contact switch such as an electromagnetic relay having a b contact configuration and an electromagnetic relay having a c contact configuration may be used. In addition, as the electromagnetic relay 57*a*, a contactless switch such as a solid state relay (SSR), a photo MOS relay, and a triac may be used.

As described above, according to the present invention, the non-sheet-feeding portion temperature rise can be suppressed without decreasing throughput also in a case where the intermediate size sheets are caused to pass the fixing nip portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-006466, filed Jan. 18, 2019, which is hereby incorporated by reference herein in its entirety.

What is claimed is:

1. A fixing apparatus for performing fixing processing on an unfixed toner image on a recording material, comprising:

a heater including at least a first heat generation member whose length in a longitudinal direction is a first length and a second heat generation member whose length in a longitudinal direction is a second length shorter than the first length;

a switching device that selects a heat generation member to which electric power is supplied from among the first heat generation member and the second heat generation member in the fixing processing; and at least one processor that executes stored instructions to perform the functions of a control unit that controls the switching device, wherein in a case where the fixing processing is performed on the recording material in which a length of the recording material in the longitudinal direction is a third length shorter than the first length and longer than the second length, the control unit controls the switching device to perform switching between the first heat generation member and the second heat generation member.

2. A fixing apparatus according to claim 1, wherein the control unit sets a timing to switch between the first heat generation member and the second heat generation member based on a count value that is counted so that the count value increases according to a sheet number of the recording materials while the fixing processing is performed continuously on the recording materials, and the count value decreases according to a drop in temperature of the heater after the fixing processing continuously performed is ended.

3. A fixing apparatus according to claim 2, wherein the control unit sets the timing based on the count value and the information on a standard size of the recording material.

4. A fixing apparatus according to claim 2, wherein the control unit sets the timing based on the count value and the information on the width of the recording materials.

5. A fixing apparatus according to claim 2, wherein the control unit sets the timing based on the count value and the width and the information on the length of the recording materials.

6. A fixing apparatus according to claim 5, wherein the control unit calculates a first degree of a temperature rise occurring in a portion where the first heat generation member is out of contact with the recording materials in a case where the first heat generation member is used to perform the fixing processing based on the width of the recording materials, and a second degree including a degree of heat necessary for the fixing processing on a portion where the second heat generation member does not heat the recording materials in a case where the second heat generation member is used to perform the fixing processing based on the width of the recording material and a degree of cooling the portion where the first heat generation member is out of contact with the recording materials, and the control unit sets the timing based on the first degree and the second degree.

7. A fixing apparatus according to claim 6, wherein the control unit determines a time corresponding to a distance between a trailing edge of a first recording material subjected to the fixing processing earlier and a leading edge of a subsequent second recording material subjected to fixing processing subsequently to the first recording material, based on the first degree.

8. A fixing apparatus according to claim 2, wherein in a case where the count value is less than a predetermined value before the fixing processing is performed continuously on the recording materials, the control unit controls the switching device according to the timing that is set after the fixing processing is performed on a predetermined sheet number of recording materials using the first heat generation member.

9. A fixing apparatus according to claim 8, wherein in a case where the count value becomes not less than the predetermined value while the fixing processing is performed continuously on the recording materials, the control unit changes the timing.

10. A fixing apparatus according to claim 9, wherein in a case where the count value becomes not less than the predetermined value, the control unit changes the timing so that a sheet number of the recording materials to be subjected to the fixing processing using the first heat generation member is smaller than a sheet number of the recording materials to be subjected to the fixing processing using the first heat generation member in a case where the count value is less than the predetermined value.

11. A fixing apparatus according to claim 8, wherein in a case where the count value is not less than the predetermined value before the fixing processing is performed continuously on the recording materials, the control unit controls the switching device according to the timing that is set.

12. A fixing apparatus according to claim 1, comprising a heatsink connecting an end portion of the first heat generation member in the longitudinal direction and an end portion of the second heat generation member in the longitudinal direction.

13. A fixing apparatus according to claim 1, wherein the fixing processing is performed on a first sheet number of recording materials by the first heat generation member in a state where electric power is supplied to the first heat generation member, and wherein when a state where electric power is supplied to the first heat generation member is switched by the switching device to a state where electric power is supplied to the second heat generation member, the fixing processing is performed by the second heat generation member on a second sheet number of recording materials, the second sheet number being less than the first sheet number.

14. A fixing apparatus according to claim 1, wherein the second heat generation member includes a third heat generation member, and a fourth heat generation member having a length in the longitudinal direction shorter than a length of the third heat generation member in the longitudinal direction.

15. A fixing apparatus according to claim 14, comprising a substrate including the first heat generation member, the third heat generation member, and the fourth heat generation member disposed on the substrate, wherein the first heat generation member includes one first heat generation member disposed at one end portion of the substrate in a transverse direction and another first heat generation member disposed at another end portion, and wherein the one first heat generation member, the third heat generation member, the fourth heat generation member, and the another first heat generation member are disposed in the transverse direction in this order.

16. A fixing apparatus according to claim 15, comprising:

a first contact electrically connected to one end portions of the one first heat generation member and the another first heat generation member;

a fourth contact electrically connected to another end portions of the one first heat generation member, the another first heat generation member, and the third heat generation member;

a second contact electrically connected to one end portions of the third heat generation member and the fourth heat generation member; and a third contact electrically connected to the another end portion of the fourth heat generation member.

17. A fixing apparatus according to claim 1, comprising:

a first rotary member, wherein the first rotary member is heated by the heater; and a second rotary member forming a nip portion with the first rotary member.

18. A fixing apparatus according to claim 17, wherein the first rotary member is a film.

19. A fixing apparatus according to claim 18, wherein the heater is provided to be in contact with an inner surface of the film, and wherein the nip portion is formed by the heater and the second rotary member via the film.

20. An image forming apparatus comprising:

an image forming unit that forms an unfixed toner image on a recording material; and a fixing apparatus according to claim 1, wherein the fixing apparatus fixes the unfixed toner image formed on the recording material by the image forming unit on the recording material.

21. A fixing apparatus according to claim 1, wherein the length in the longitudinal direction of the first heat generation member corresponds to a length of a letter-size sheet as the recording material in the longitudinal direction, and wherein the length in the longitudinal direction of the second heat generation member corresponds to a length of a B5 sheet recording material as the recording material in the longitudinal direction.

22. A fixing apparatus according to claim 1, wherein the control unit controls a time period in which a power is supplied to the first heat generation member and a time period in which a power is supplied to the second heat generation member according to the third length as the length of the recording material.

23. A fixing apparatus according to claim 1, wherein the first length corresponds to a length of an A4 sheet in the longitudinal length, and the second length corresponds to a length of a B5 sheet in the longitudinal length.

* * * * *